United States Patent [19]

Matushita et al.

[11] Patent Number: 5,066,573

[45] Date of Patent: Nov. 19, 1991

[54] SILVER HALIDE COLOR PHOTOGRAPHIC MATERIAL

[75] Inventors: Tetunori Matushita; Morio Yagihara; Kei Sakanoue, all of Kanagawa, Japan

[73] Assignee: Fuji Photo Film Co., Ltd., Kanagawa, Japan

[21] Appl. No.: 480,348

[22] Filed: Feb. 12, 1990

Related U.S. Application Data

[63] Continuation of Ser. No. 230,830, Aug. 11, 1988, abandoned.

[30] Foreign Application Priority Data

Aug. 11, 1987 [JP] Japan ..... 62-200233

[51] Int. Cl.[5] ..... G03C 1/08

[52] U.S. Cl. ..... 430/542; 430/600; 430/603; 430/611; 430/926; 430/955; 430/959

[58] Field of Search ..... 430/542, 600, 603, 611, 430/926, 955, 959

[56] References Cited

U.S. PATENT DOCUMENTS 4,518,685 5/1985 Yagihara et al. ..... 430/959

4,659,651 4/1987 Yagihara et al. ..... 430/611

*Primary Examiner*—Hoa Van Le

*Attorney, Agent, or Firm*—Sughrue, Mion, Zinn, Macpeak & Seas

[57] ABSTRACT

A silver halide color photographic material is described, comprising a support having thereon at least one of a silver halide emulsion layer and other hydrophilic colloid layer, wherein the silver halide emulsion layer or a hydrophilic colloid layer contains at least one compound represented by formula (II):

(I)

wherein $R_2$ represents a hydrogen atom or a group that can be substituted, $Y_1$ represents $R_4$, $R_5$, $R_6$, $R_7$ and $R_8$, which may be the same or different, each represents a hydrogen atom or a group that can be substituted; $X_1$ represents a divalent linking group containing a hetero atom connected to the carbon atom; m is 0 or 1; A represents a bleach accelerating agent moiety represented by $$-S-R_9\text{-}(X_2-R_{10})_{l1}\text{-}(B)_{l2} \text{ or}$$

wherein $R_9$, L, $X_2$ $R_{10}$ B, $l_1$ and $L_2$ are defined in the specification.

The compound represented by formula (II) is a bleach accelerating agent having an active group of adsorptive group.

The silver halide color photographic material has a high blocked speed and can be used in rapid processing.

19 Claims, No Drawings

SILVER HALIDE COLOR PHOTOGRAPHIC MATERIAL

This is a continuation of application Ser. No. 230,830, filed Aug. 11, 1988, now abandoned.

FIELD OF THE INVENTION

The present invention relates to a silver halide color photographic material, and more particularly, to a silver halide color photographic material containing a novel compound in which an active group or an adsorptive group of a bleach accelerating agent is blocked

BACKGROUND OF THE INVENTION

The fundamental steps of processing color photographic light-sensitive materials generally include a color developing step and a silver removing (i.e., a desilvering) step. Thus, an exposed silver halide color photographic material is introduced into a color developing step, where silver halide is reduced with a color developing agent to produce silver and the oxidized color developing agent in turn reacts with a color former to yield a dye image. Subsequently, the color photographic material is introduced into a silver removing step, where silver produced in the preceding step is oxidized with an oxidizing agent (usually called a bleaching agent), and dissolved away with a silver ion complexing agent usually called a fixing agent. Therefore, only a dye image is formed in the thus-processed photographic material. In addition to the above described two fundamental steps of color development and silver removal, actual development processing involves auxiliary steps for maintaining the photographic and physical quality of the resulting image or for improving the preservability of the image. For example, such processes include a hardening bath for preventing a light-sensitive layer from being excessively softened during photographic processing, a stopping bath for effectively stopping the developing reaction, an image stabilizing bath for stabilizing the image, and a layer removing bath for removing the backing layer on the support.

The above described silver removal step may be conducted in two ways: one uses two steps employing a bleaching bath and a fixing bath; and the other is more simple and is conducted in one step employing a bleach-fixing bath containing both a bleaching agent and a fixing agent for the purpose of accelerating the processing and labor elimination.

In recent years, bleach processing using a ferric ion complex salt (e.g., aminopolycarboxylic acid-ferric ion complex salt, particularly iron (III) ethylenediaminetetraacetate complex salt) as a major bleach bath component has mainly been employed in processing color photographic light-sensitive materials in view of the acceleration and simplification of the bleaching provided and the need for preventing environmental pollution.

However, ferric ion complex salts have a comparatively low oxidizing power and, therefore, have insufficient bleaching ability.

In order to raise the bleaching ability of a bleaching solution or a bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include 5-membered heterocyclic mercapto compounds as described in British Patent 1,138,842, thiadiazole derivatives as described in Swiss Patent 336,257, thiourea derivatives, and thiazole derivatives, etc. However, these compounds do not necessarily have sufficient bleach accelerating effects when they are added to a bleaching solution or a prebath thereof. Also, insufficient bleach accelerating effects are obtained when they are added to a bleach-fixing solution or a prebath thereof. Further, in the latter case they react with silver ions present in the bleach-fixing solution to form a precipitate which creates many troubles. For example, the precipitate can block filters of a circulation system in an automatic processing machine, and it adheres to photographic light-sensitive materials, resulting in stain formation.

A processing method is also known wherein a 5-membered heterocyclic compound containing two or three nitrogen atoms as ring constituting members and having at least one mercapto group is added to a bath just before a bath of the bleaching processing as described in JP-A-54-52534 (the term "JP-A-" as used herein means an "unexamined published Japanese patent application"). However, when these compounds are directly added to a bleaching solution or a bleach-fixing solution, sufficient bleach accelerating effects cannot be obtained. In addition, they lack stability in the processing solution and cannot endure use for a long period of time.

Furthermore, heterocyclic alkylmercaptan derivatives as described in JP-A-53-32736, disulfide compounds as described in JP-A-53-95630, isothiourea derivatives as described in *Research Disclosure,* No. 15704 (May, 1977), and aminoalkylmercaptan derivatives as described in U.S. Pat. No. 3,893,858 are known as bleach accelerating agents. However, these bleach accelerating agents have various disadvantages, although some of them show a satisfactory bleach accelerating effect. More specifically, when these compounds are added to a bleaching solution and color photographic materials are continuously processed using such a bleaching solution, precipitate occurs in the bleaching solution, which causes many difficulties. The precipitate clogs filters of a circulation system in an automatic processing machine and adheres to photographic light-sensitive materials, resulting in stain formation. Further, it is also known that the bleach accelerating effect is reduced under running conditions. This is believed to be due to the fact that thiol or disulfide is converted to a thiolsulfonate ion by a sulfite ion which is carried over from a developing solution into a bleaching solution and thus loses its adsorbing ability to developed silver.

Therefore, in order to effectively accelerate silver removal, it has been proposed to incorporate such a bleach accelerating agent into a silver halide color photographic material instead of adding the compound to a processing bath such as a bleaching bath or a bleach-fixing bath. However, many compounds which are generally designated bleach accelerating agents form undesired fog when they are directly incorporated into color photographic light-sensitive materials. Moreover, they cause decrease in sensitivity and change in photographic characteristics (such as sensitivity, gradation, fog, etc.) and can not be practically employed.

Many attempts have been made to overcome such problems as fog formation caused by the incorporation of bleach accelerating agent into a color photographic light-sensitive material and to further increase the bleach accelerating effect. For instance, there is a method of using a bleach accelerating agent in the form of a salt (for example, a silver salt, etc.) with a heavy metal ion as described in JP-A-53-134430, JP-A-53-147529 and JP-A-55-64237. However, this method does not provide a sufficient bleach accelerating effect. Also, methods utilizing a bleach accelerator releasing coupler are described in *Research Disclosure,* No. 11449 (1973) and JP-A-61-201247. However, these known bleach accelerator releasing couplers can release bleach accelerating agents only at color development and do not release them at the time of bleaching or bleach-fixing, and thus their bleach accelerating effects are still unsatisfactory. Further improvement, accordingly, has been desired.

SUMMARY OF THE INVENTION

An object of the present invention is, therefore, to provide a silver halide color photographic material which contains a bleach accelerating agent in a stable form, and provides a sufficiently high bleach accelerating function during processing for the purpose of stabilizing a processing solution, accelerating and simplifying the processing.

Another object of the present invention is to provide a silver halide color photographic material containing a blocked bleach accelerating agent having a bleach accelerating effect which is not reduced even under running conditions.

A further object of the present invention is to provide a silver halide color photographic material having a high bleaching rate and capable of being used in rapid processing.

Other objects of the present invention will become apparent from the following description and examples.

It has now been discovered that these and other objects of the present invention are attained by a silver halide color photographic material comprising a support having thereon at least one of a silver halide emulsion layers and other hydrophilic colloid layers, wherein the silver halide emulsion layer or the hydrophilic colloid layer contains at least one compound represented by formula (I):

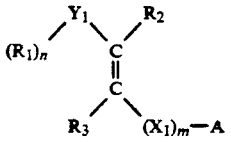

(I)

wherein $R_1$, $R_2$ and $R_3$, which may be the same or different, each represents a hydrogen atom or a group that can be substituted, provided that $R_1$ and $R_2$ or $R_1$ and $R_3$ may be linked to form a carbocyclic ring or a heterocyclic ring; n is 0 or 1; $Y_1$ represents

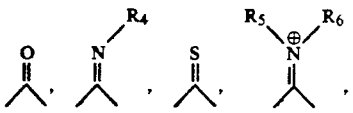

-continued

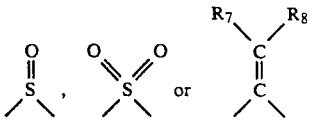

when n represents 1, and $Y_1$ represents a cyano group or a nitro group when n represents 0; $R_4$, $R_5$, $R_6$, $R_7$ and $R_8$, which may be the same or different, each represents a hydrogen atom or a group that can be substituted; $X_1$ represents a divalent linking group containing a hetero atom connected to the carbon atom; m is 0 or 1; A represents a bleach accelerating agent moiety connected to $X_1$ or the carbon atom through a hetero atom and represented by

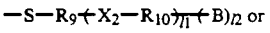

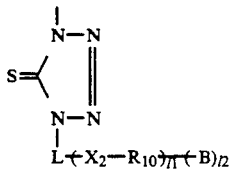

wherein $R_9$ represents a divalent, trivalent or tetravalent aliphatic group having from 1 to 8 carbon atoms or

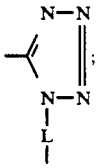

L represents a divalent, trivalent or tetravalent aliphatic group having from 1 to 8 carbon atoms; $X_2$ represents an oxygen atom, a sulfur atom,

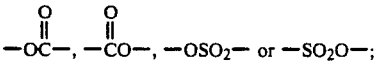

$R_{10}$ represents a divalent, trivalent or tetravalent aliphatic group having from 1 to 8 carbon atoms; B represents a water solubilizing group or a water solubilizing group precursor; $l_1$ is 0, 1, 2 or 3, provided that when $l_1$ is 2 or 3, the plural $X_2$–R10 groups may be the same or different; and $l_2$ is 1, 2 or 3, provided that when $l_2$ is 2 or 3, the plural B groups may be the same or different.

DETAILED DESCRIPTION OF THE INVENTION

The compound represented by formula (I) can release a bleach accelerating agent during processing upon the addition of a nucleophilic reagent (for example, an $OH^-$ ion) to the unsaturated bond present therein.

In order to block the active group which is released by means of application of the addition of a nucleophilic reagent to the unsaturated bond, the methods as described in JP-A-59-201057, JP-A-61-43739 and JP-A-61-95347 can be employed.

The compound represented by formula (I) will be described in greater detail below.

The bleach accelerating agent moiety represented by A in the formula (I) may be connected directly (when m is 0) to the carbon atom through a hetero atom present therein or may be connected via $X_1$ (when m is 1) to the carbon atom. Preferably, m is 0. A represents $$-S-R_9\left(X_2-R_{10}\right)_{n}\left(B\right)_{l2} \text{ or}$$

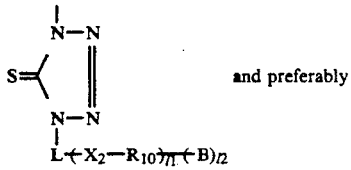

and preferably $$-S-R_9\left(X_2-R_{10}\right)_{n}\left(B\right)_{l2}.$$

$R_1$ in the formula (I) represents a hydrogen atom or a group that can be substituted. Suitable examples the group that can be substituted include an alkyl group (preferably having from 1 to 20 carbon atoms), an alkenyl group (preferably having from 2 to 20 carbon atoms), an aryl group (.preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an amino group (including an unsubstituted amino group and preferably a secondary or tertiary amino group substituted with an alkyl group having from 1 to 20 carbon atoms or an aryl group having from 6 to 20 carbon atoms), a hydroxyl group. The group that can be substituted represented by $R_1$ may have one or more substituents described below. When two or more substituents are present, they may be the same or different. Specific examples of the substituents which are substituted to $R_1$ include a halogen atom (for example, fluorine, chlorine, bromine atom), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, an oxycarbonyl group (preferably an alkoxycarbonyl group having from 1 to 20 carbon atoms or an aryloxycarbonyl group having from 6 to 20 carbon atoms), a hydroxyl group, a carboxyl group, a sulfo group, a ureido group (preferably an alkylureido group having from 1 to 20 carbon atoms or an arylureido group having from 6 to 20 carbon atoms), a sulfonamide group (preferably an alkylsulfonamide group having from 1 to 20 carbon atoms or an arylsulfonamide group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbonyl group having from 1 to 20 carbon atoms or an arylcarbamoyl group having from 6 to 20 carbon atoms), an acyloxy group (preferably having from 1 to 20 carbon atoms), an amino group (including an unsubstituted amino group and preferably a secondary or a tertiary amino group substituted with an alkyl group having from 1 to 20 carbon atoms or an aryl group having from 6 to 20 carbon atoms), a carbonic acid ester group (preferably an alkyl carbonic acid ester having from 1 to 20 carbon atoms or an aryl carbonic acid ester having from 6 to 20 carbon atoms), a sulfone group (preferably an alkylsulfone group having from 1 to 20 carbon atoms or an arylsulfone group having from 6 to 20 carbon atoms), and a sulfinyl group (preferably an alkylsulfinyl group having from 1 to 20 carbon atoms or an arylsulfinyl group having from 6 to 20 carbon atoms). Among these, particularly preferred substituents which are substituted to $R_1$ include an alkyl group having from 1 to 20 carbon atoms, an alkoxy group having from 1 to 20 carbon atoms, and a secondary or tertiary amino group substituted with an alkyl group having from 1 to 20 carbon atoms or an aryl group having from 6 to 20 carbon atoms.

Further, $R_1$ may combine with $R_2$ or $R_3$ to form a carbocyclic ring or a heterocyclic ring (for example, a 5-membered, 6-membered or 7-membered ring).

$R_2$ and $R_3$ in the formula (I) may be the same or different and each represents a hydrogen atom or a group that can be substituted. Specific examples of the group that can be substituted represented by $R_2$ and $R_3$ include a halogen atom (for example, fluorine, chlorine, bromine), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyloxy group (preferably having from 2 to 20 carbon atoms), an amino group (including an unsubstituted amino group and preferably a secondary or a tertiary amino group substituted with an alkyl group having from 1 to 20 carbon atoms or an aryl group having from 6 to 20 carbon atoms), a carbonamide group (preferably an alkylcarbonamide group having from 1 to 20 carbon atoms or an arylcarbonamide group having from 6 to 20 carbon atoms), a ureido group (preferably an alkylureido group having from 1 to 20 carbon atoms or an arylureido group having from 6 to 20 carbon atoms), a carboxy group, a carbonic acid ester group (preferably an alkyl carbonic acid ester having from 1 to 20 carbon atoms or an aryl carbonic acid ester having from 6 to 20 carbon atoms), an oxycarbonyl group (preferably an alkoxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfo group, a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a sulfamoyl group (preferably an alkylsulfamoyl group having from 1 to,20 carbon atoms or an arylsulfamoyl group having from 6 to 20 carbon atoms), a cyano group or a nitro group. Among these, particularly preferred $R_2$ and $R_3$ include a hydrogen atom, a halogen atom, a acyl group, a nitro group, and an alkyl group. The substituent represented by $R_2$ or $R_3$ may have one or more substituents. When two or more substituents are present, they may be the same or different. Specific examples of the substituents include those described for $R_1$ above.

In the formula, (I), when n represents 1, $Y_1$ represents

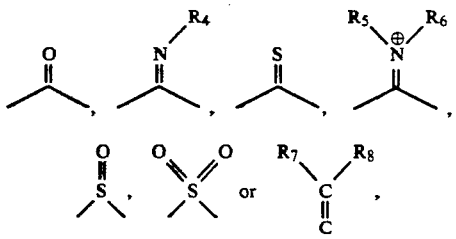

and, when n represents 0, $Y_1$ represents a cyano group or a nitro group; and $R_4$, $R_5$, $R_6$, $R_7$ and $R_8$, which may be the same or different, each represents a hydrogen atom or a group that can be substituted. Specific examples of the group that can be substituted which is represented by $R_4$, $R_5$, $R_6$, $R_7$ and $R_8$ include an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an acyloxy group (preferably having from 2 to 20 carbon atoms), an amino group (including an unsubstituted amino group and preferably a secondary or a tertiary amino group substituted with an alkyl group having from 1 to 20 carbon atoms or an aryl group having from 6 to 20 carbon atoms), a carbonamide group (preferably an alkylcarbonamino group having from 1 to 20 carbon atoms or an arylcarbonamide group having from 6 to 20 carbon atoms), a ureido group (preferably an alkylureido group having from 1 to 20 carbon atoms or an arylureido group having from 6 to 20 carbon atoms), an oxycarbonyl group (preferably an alkyloxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a sulfamoyl group (preferably an alkylsulfamoyl group having from 1 to 20 carbon atoms or an arylsulfamoyl group having from 6 to 20 carbon atoms), a cyano group or a nitro group. Among them, preferred groups that can be substituted which are represented by $R_7$ or $R_8$ include an oxycarbonyl group, a carbamoyl group, an acyl group, a sulfonyl group, a sulfamoyl group, a sulfinyl group, a cyano group and a nitro group.

The group that can be substituted which is represented by $R_7$ or $R_8$ may have one or more substituents. They may be the same or different, when two or more substituents are present. Specific examples of the substituents include those as described for $R_1$ above.

$X_1$ in the formula (I) represents a divalent linking group, which is connected to the carbon atoms through a hetero atom contained therein. The bond between $X_1$ and the carbon atom is cleaved during the photographic processing (for example, at development, fixing, bleach-fixing), and the resulting $X_1$–A promptly releases a bleach accelerating agent corresponding to A.

Specific examples of the linking group of the above-described kind include one which releases A upon an intramolecular ring-closing reaction, as described in JP-A-54-145135 (corresponding to BP-A-2,010,818), U.S. Pat. Nos. 4,248,962 and 4,409,323 and Britishi Patent 2,096,784; one which releases A through intramolecular electron transfer, as described in British Patent 2,072,363, JP-A-57-154234; one which releases A with the elimination of carbon dioxide, as described in JP-A-57-179842 and one which releases A with the elimination of formaldehyde, as described in JP-A-59-93422.

Structural formulae of representative groups represented by $X_1$ are illustrated together with A below but the present invention is not to be construed as being limited thereto:

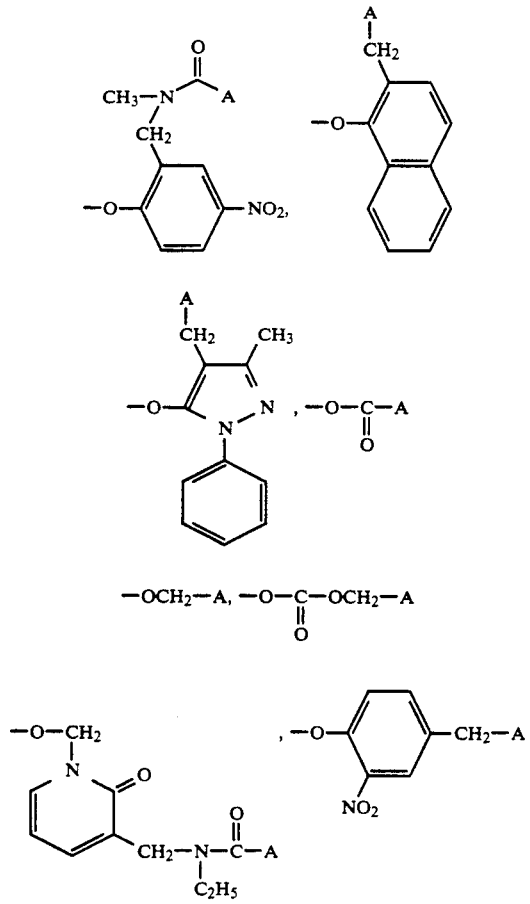

-continued

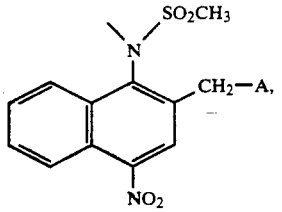

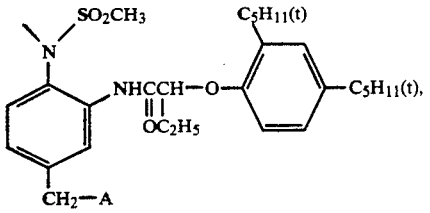

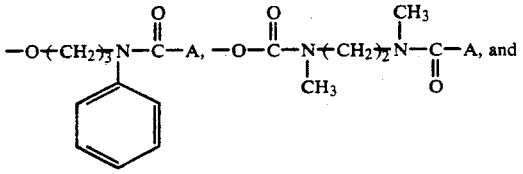

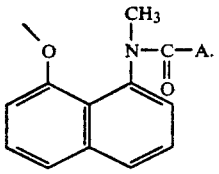

In the bleach accelerating agent moiety represented by A, the divalent, trivalent or tetravalent aliphatic group represented by $R_9$, $R_{10}$ or L may be saturated or unsaturated, or straight chain, branched chain or cyclic. Among the above aliphatic group, an alkylene group which may be substituted is preferred. Representative examples thereof are shown below, but the present invention is not to be construed as being limited thereto:

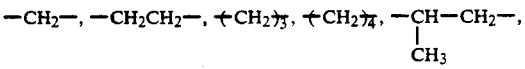

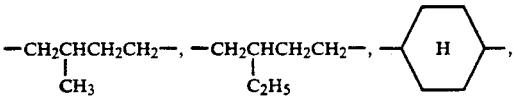

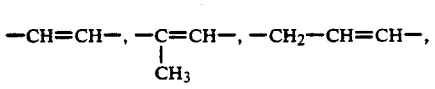

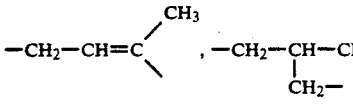

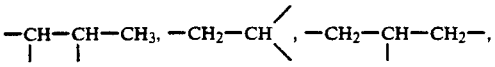

-continued

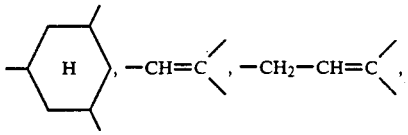

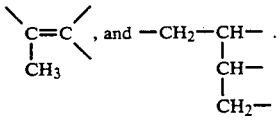

B in the bleach accelerating agent moiety represents a water solubilizing group, preferably a carboxyl group, or a precursor thereof such as —COOM, —$COOCH_3$, —$COOC_2H_5$ and

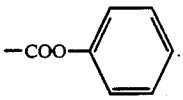

For example, B may be an ester group which form a water-soluble carboxylic acid group upon hydrolysis. Representative examples thereof are shown below, but the present invention is not to be construed as being limited thereto:

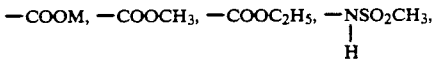

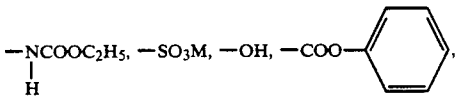

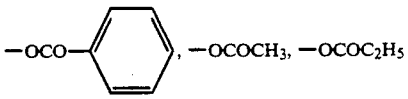

wherein M represents a hydrogen atom, an alkali metal atom, a quaternary ammonium group or a quaternary phosphonium group.

Of the compounds represented by the formula (I), those represented by the formulae (II) or (III) described below are preferred.

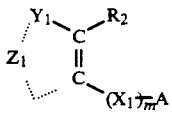

(II)

-continued

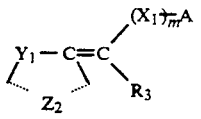

(III)

wherein $Z_1$ represents an atomic group necessary for forming a carbocyclic ring or a heterocyclic ring; and $R_2$ $R_3$, $X_1$, $Y_1$, A and m each has the same meaning as defined in the formula (I).

The ring formed by $Z_1$ includes, for example, a 5-membered, 6-membered or 7-membered carbocyclic ring, a 5-membered, 6-membered or 7-membered heterocyclic ring containing one or more nitrogen atoms, oxygen atoms and sulfur atoms or a condensed ring containing the carbocyclic ring or heterocyclic ring. Specific examples of the ring formed by $Z_1$ include cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumarin, chromone, uracil,

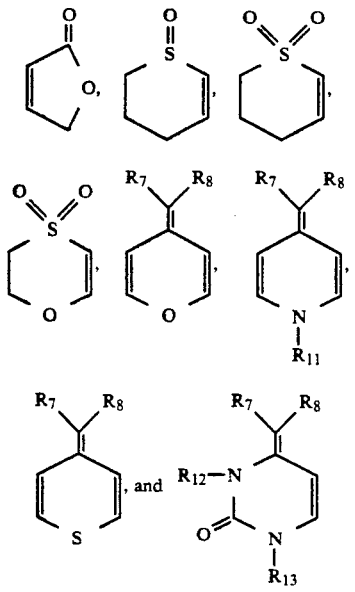

(wherein $R_7$ and $R_8$ each has the same meaning as defined above; and $R_{11}$, $R_{12}$ and $R_{13}$, which may be the same or different, each represents hydrogen, an alkyl group, an alkenyl group, an aryl group, an aralkyl group or an acyl group, (preferably having from 1 to 16 carbon atoms). Among these, cyclopentenone, cyclohexenone and uracil are preferred, and uracil are particularly preferred.

The carbocyclic ring or heterocyclic ring may be substituted with one or more substituents and when two or more substituents are present they may be the same or different. Specific examples of the substituents include those described for $R_1$ above.

The ring formed by $Z_2$ includes the rings formed by $Z_1$. Specific examples of the ring formed by $Z_2$ include cyclopentanone, cyclohexanone, cycloheptanone, benzocycloheptanone, benzocyclopentanone, benzocyclohexanone, 4-tetrahydropyridone, 4-dihydroquinolone and 4-tetrahydropyrone. Among these, cyclopentanone and cyclohexanone are preferred.

The carbocyclic ring or heterocyclic ring may be substituted one or more substituents, and when two or more substituents are present they may be the same or different. Specific examples of the substituents include those described for $R_1$ above.

In the formula (I), $R_1$, $R_2$, $R_3$, $R_4$, $R_5$, $R_6$, $R_7$ and $R_8$ are selected depending upon the pH value and the composition of the processing solution to be used for processing the photographic material in which the compound represented by the formula (I) according to the present invention is incorporated, and upon the time required for timing.

In addition to selection of pH of the processing solution, it is possible to control the releasing rate of the bleach accelerating agent over a wide range by using a nucleophilic substance, especially a sulfite ion, hydroxylamine, a thiosulfate ion, a metabisulfite ion, a hydroxamic acid or similar compound as described in JP-A-59-198453, an oxime compound as described in JP-A-60-35729, or a dihydroxybenzene type developing agent, a 1-phenyl-3-pyrazolidone type developing agent, a p-aminophenol type developing agent, each described hereinafter.

The amount of such a nucleophilic substance added is usually from about 1 to about $10^8$ times by mol, preferably from about $10^2$ to about $10^6$ times by mol of the compound according to the present invention.

Specific examples of the compounds according to the present invention are set forth below, but the present invention is not to be construed as being limited thereto.

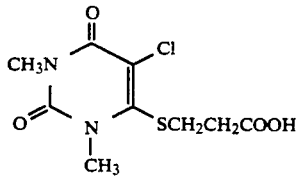

(1)

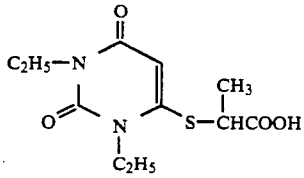

(2)

-continued
(3)
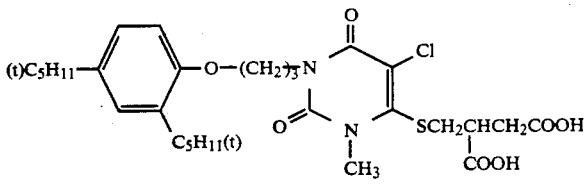
(4)
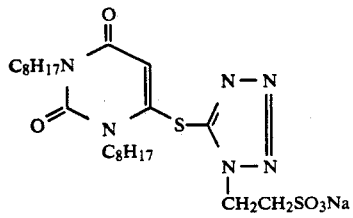
(5)
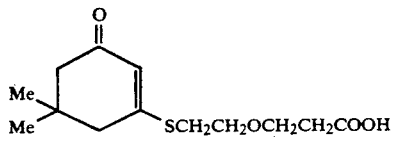
(6)
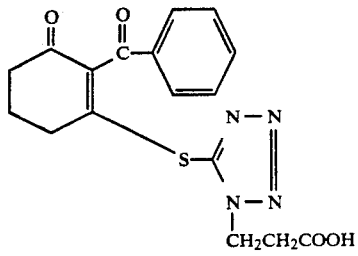
(7)
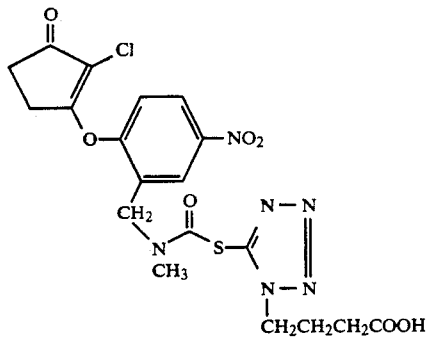
(8)
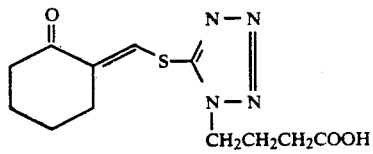
(9)
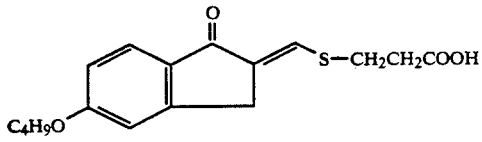
(10)
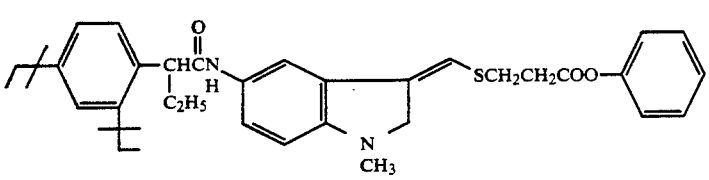

-continued
(11)
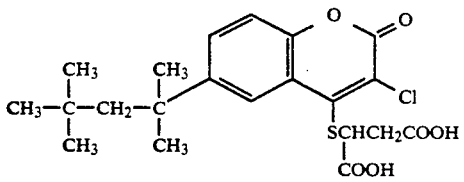
(12)
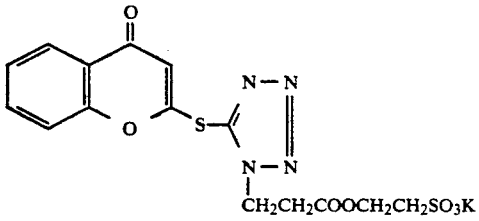
(13)
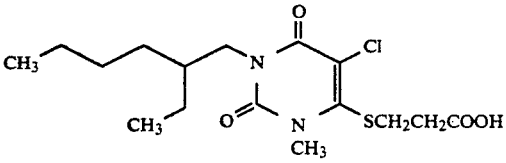
(14)
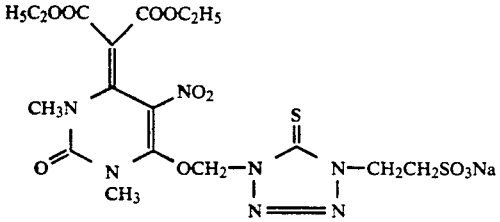
(15)
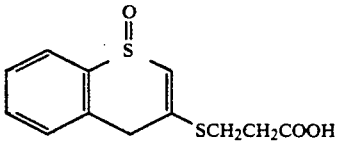
(16)
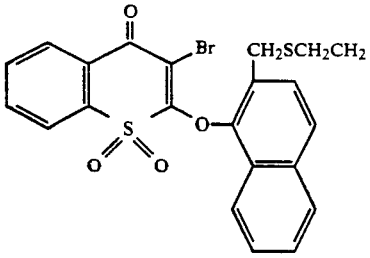
(17)
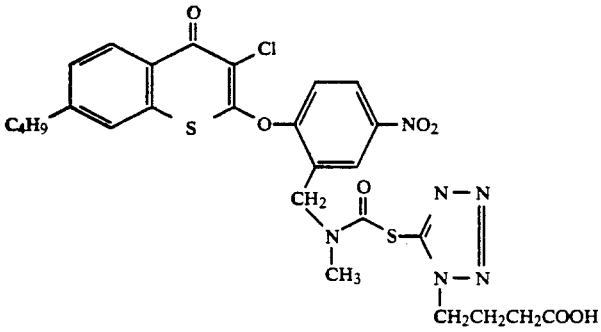

-continued
(18)
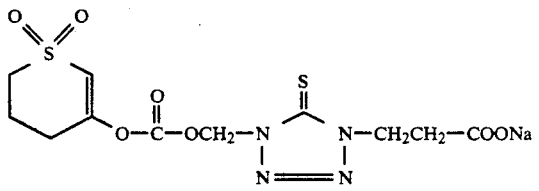
(19)
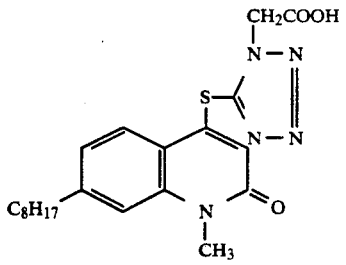
(20)
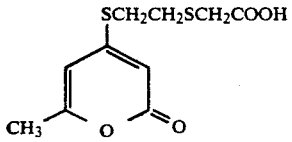
(21)
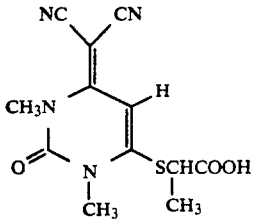
(22)
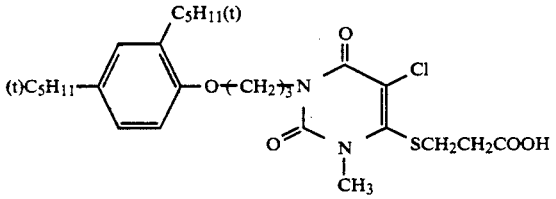
(23)
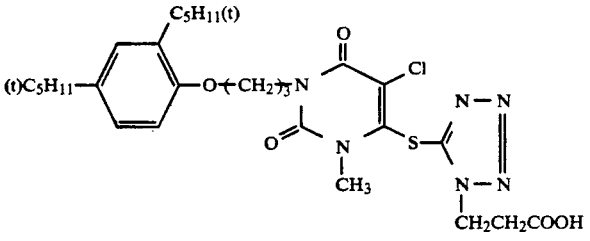
(24)
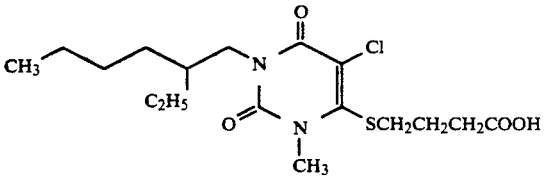

-continued
(25)
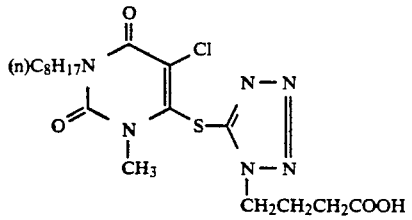
(26)
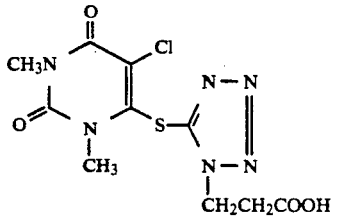
(27)
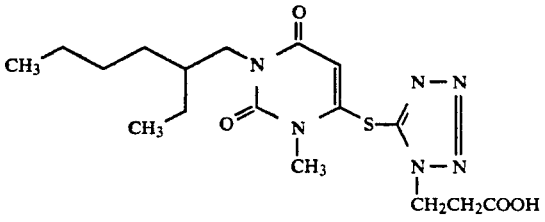
(28)
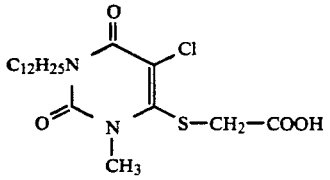
(29)
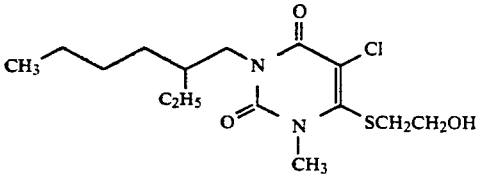
(30)
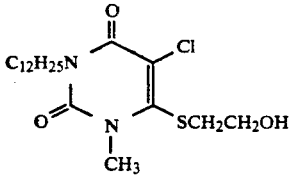
(31)
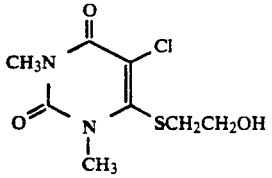
(32)
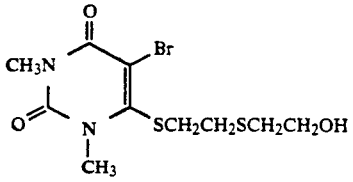

-continued

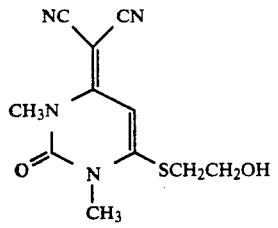

(33)

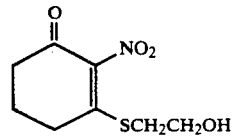

(34)

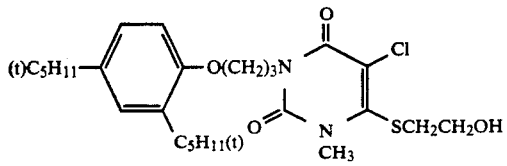

(35)

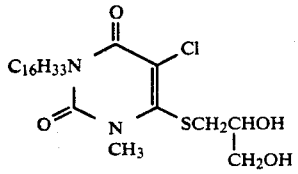

(36)

In the compounds described above

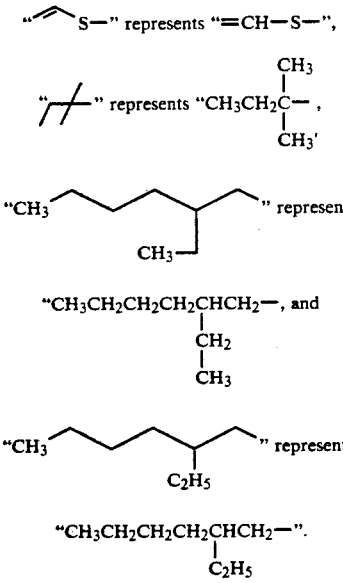

The compounds represented by the formula (I) according to the present invention can be synthesized by the methods described in JP-A-59-201057, JP-A-61-43739 and JP-A-61-95347.

Specific examples of synthesis methods for the compounds according to the present invention are described below, but the present invention is not to be construed as being limited thereto.

SYNTHESIS EXAMPLE 1

Synthesis of Compound (1)

6-Chloro-1,3-dimethyluracil was synthesized according to the method as described in *Liebigs Ann. Chem.*, Bd. 612, page 161 (1958) in the following manner.

276 g (3.14 mol) of 1,3-dimethylurea and 376 g (3.62 mol) of malonic acid were dissolved in 600 ml of glacial acetic acid at 60° to 70° C. To the solution was added 1250 ml of acetic anhydride and the temperature was gradually raised to 90° C. After stirring for 6 hours, the reaction mixture was allowed to stand at room temperature overnight and then the glacial acetic acid and acetic anhydride were distilled off under reduced pressure. The residue was poured into 500 ml of ethanol while it was still hot, the crystals thus-deposited were collected by filtration and refluxed by heating in a mixture of 380 ml of concentrated hydrochloric acid and 400 ml of water for 2 hours. The mixture was allowed to stand under cooling with ice for 6 hours, the crystals thus-deposited were collected by filtration and washed with a small amount of ethanol to obtain 360 g of 1,3-dimethylbarbituric acid.

To 110 g of 1,3-dimethylbarbituric acid thus-obtained was added 32 ml of water and then was gradually added dropwise 800 ml of phosphorus oxychloride. The mixture was refluxed by heating for 1.5 hours, the phosphorus oxychloride was distilled off under normal pressure and the residue was poured onto ice while it was still hot. The crystals thus-deposited were collected by filtration, the filtrate was extracted three times with chloroform and dried with anhydrous sodium sulfate. The chloroform was distilled off and the residue thus-obtained was recrystallized from water together with the crystals obtained above to obtain 80 g of 6-chloro-1,3-dimethyluracil.

To 70 ml of an acetonitrile solution containing 21 g of 6-chloro-1,3-dimethyluracil thus-obtained was added 16 g of N-chlorosuccinimide under cooling with ice (at the solution temperature of 5° C). The temperature was gradually raised to 35° C. After further stirring for 1 hour, 70 ml of water was added to the reaction solution, and the crystals thus-deposited were collected by filtration, washed with a cold solvent mixture of 18 ml of acetonitrile and 18 ml of water and dried to obtain 18 g of 5,6-dichloro-1,3-dimethyluracil.

To 15 ml of an acetonitrile solution containing 4 g of 3-mercaptopropionic acid was added dropwise 10 ml of an acetonitrile solution containing 12.6 g of 1,8-diazabicyclo[5,4,0]undecene-7 (DBU) in a nitrogen atmosphere and the mixture was stirred at room temperature for 10 minutes Then, 7.9 g of 5,6-dichloro-1,3-dimethyluracil was added thereto and the mixture was stirred at room temperature for 1 hour. The acetonitrile was distilled off under reduced pressure, to the residue were added 6 ml of concentrated hydrochloric acid and 30 ml of water, and then the mixture was extracted with 100 ml of chloroform. The organic layer was dried with anhydrous magnesium sulfate and then the chloroform was distilled off under reduced pressure. The residue was recrystallized from ethyl acetate to obtain 8.5 g of Compound (1). Melting Point 141° to 143° C.

SYNTHESIS EXAMPLE 2

Synthesis of Compound (5)

To 200 ml of a chloroform solution containing 100 g (0.71 mol) of dimedone was added 21 ml of phosphorus trichloride and the mixture was refluxed by heating for 3 hours. To the reaction solution was added ice water to terminate the reaction, the chloroform was distilled off under reduced pressure and the aqueous layer was extracted with ethyl acetate. The organic layer was dried with anhydrous sodium sulfate, concentrated under reduced pressure and the residue was purified by distillation under reduced pressure to obtain 45 g of 3-chloro-5,5-dimethyl-2-cyclohexen-1-one. Yield: 40 %, Boiling Point 95° C. at 18 mmHg.

To 15 ml of acetonitrile solution containing 3 g of 3-(2-mercaptoethoxy)propionic acid was added dropwise 10 ml of acetonitrile solution containing 6.8 g of 1,8-diazabicyclo[5,4,0]undecene-7 (DBU) in a nitrogen atmosphere and the mixture was stirred at room temperature for 5 minutes. Then, 5 ml of an acetonitrile solution containing 3.2 g of 3-chloro-5,5-dimethyl-2-cyclohexen-1-one was added thereto and the mixture was stirred at room temperature for 1.5 hours. The acetonitrile was distilled off under reduced pressure, to the residue were added 3 ml of hydrochloric acid and 30 ml of water and then it was extracted with 70 ml of chloroform. The organic layer was dried with anhydrous magnesium sulfate and then the chloroform was distilled off under reduced pressure To the residue was added n-hexane, the crystals thus-deposited were collected by filtration to obtain 4.8 g of Compound (5). Melting Point: 134° to 136° C.

SYNTHESIS EXAMPLE 3

Synthesis of Compound (8)

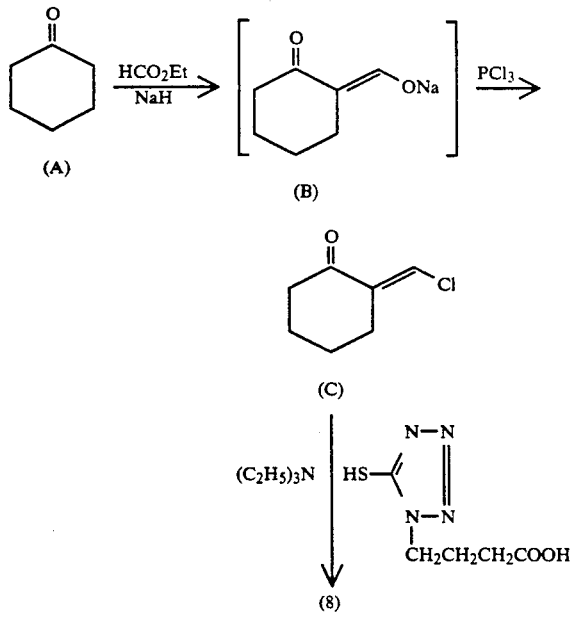

20 g (0.2 mol) of cyclohexanone and 16 g (0.2 ethyl formate were dissolved in 400 ml of dry ether, and cooled in an ice bath. To the cooled solution was added 16 g (0.4 mol) of NaH (concentration: over a 1 hour period. After the addition was concluded, the stirring was continued at room temperature for 6 hours. The reaction mixture ((B) in the foregoing reaction scheme precipitated) was kept cooling in an ice bath and thereto 150 ml of an ether solution containing 27 g (0.2 mol) of $PCl_3$ was added dropwise. After the conclusion of dropwise addition, the stirring was continued at room temperature for 3 hours. The crystals thus deposited were removed by filtration under reduced pressure The mother liquid was concentrated to yield 31 g of an oily product. The oily product was dissolved in 200 ml of dry tetrahydrofuran (THF) without further purification, and added dropwise by means of a dropping funnel at room temperature into the system in which 37.6 g (0.2 mol) of 5-mercapto-1-(3-carboxypropyl) tetrazole and 44 g (0.4 mol) of triethylamine were dissolved in 500 ml of dry tetrahydrofuran. The reaction mixture was stirred for 5 hours. Thereafter, the tetrahydrofuran was distilled off under reduced pressure To the residue were added 26 ml of hydrochloric acid and 200 ml of water and then it was extracted twice with 500 ml of chloroform. The organic layer was dried with anhydrous magnesium sulfate and then the chloroform was distilled off under reduced pressure to obtain 58 g of crude crystals. These crystals were recrystallized twice from ethyl acetate and n-hexane to obtain 39 g of the desired Compound (8) as light yellow crystals. Melting Point: 162 to 164° C.

SYNTHESIS EXAMPLE 4

Synthesis of Compound (11)

3,4-Dichloro-6-tert-octylcoumarin was synthesized according to the methods as described in *J. Am. Chem. Soc.*, Vol. 81, page 2266 (1959) in the following manner.

To 39 g of anhydrous aluminium chloride was added 120 ml of carbon disulfide and the resulting slurry was gradually added to 50 ml of a carbon disulfide solution containing 30 g of 4-tert-octylphenol, and the mixture was stirred until the generation of hydrogen chloride gas was completed at room temperature. Then, 36.2 g of hexachloropropene was added dropwise thereto over a period of 20 minutes and the mixture was stirred until the generation of hydrogen chloride gas was completed at room temperature. After distilling off the carbon disulfide under reduced pressure, to the residue was added a cold (about 5° to 10 ° C.) sulfuric acid solution (20 ml of concentrated sulfuric acid and 100 ml of water) and the mixture was stirred for 10 minutes. 100 ml of dichloromethane was added thereto and extracted three times. The organic layer was washed with a saturated aqueous sodium chloride solution and then washed with water, and dried with anhydrous magnesium sulfate. The dichloromethane was distilled off under reduced pressure, and the residue was purified by silica gel column chromatography to obtain 28 g of 3,4-dichloro-6-tert-octylcoumarin as an oily product.

To 15 ml of an acetonitrile solution containing 6 g of 2-mercaptosuccinic acid was added dropwise 20 ml of an acetonitrile solution containing 19 g of 1,8-diazabicyclo[5,4,0]undecene-7 (DBU) in a nitrogen atmosphere and the mixture was stirred at room temperature for 5 minutes. Then, 20 ml of an acetonitrile solution containing 13 g of 3,4-dichloro-6-tert-octylcoumarin was added dropwise thereto and the mixture was stirred at room temperature for 2 hours. The acetonitrile was distilled off under reduced pressure, to the residue were added 16 ml of hydrochloric acid and 30 ml of water and then extracted three times with 100 ml of chloroform. The organic layer was dried with anhydrous magnesium sulfate and then the chloroform was distilled off under reduced pressure. To the residue was added a solvent mixture of n-hexane and diethyl ether, and the crystals thus deposited were collected by filtration to obtain 10.2 g of Compound (11). Melting Point: 126° to 128° C.

SYNTHESIS EXAMPLE 5

Synthesis of Compound (13)

Into a 300 ml reaction vessel equipped with a distillation apparatus were introduced 50 g of 2-ethylhexylamine, 29 g of methyl carbamate and 100 ml of toluene, and to the mixture was added 0.1 g of dibutyl tin oxide as a catalyst and heated with stirring. Methanol formed during the reaction was removed, when the reflux temperature was raised to 110° C., i.e., the boiling point of toluene, the distillation apparatus was taken off and instead a reflux condenser was attached and the mixture was refluxed by heating for 30 minutes with stirring, then allowed to cool. The toluene was distilled off under reduced pressure, and the residue was washed with n-hexane and collected by filtration to obtain 61 g of N-(2-ethylhexyl)urea.

A solution of 500 g of N-(2-ethylhexyl)urea and 36 g of malonic acid in 100 ml of acetic acid was heated at 80° C. and stirred for 4 hours. After allowing to cool, the acetic acid was removed under reduced pressure and extracted by adding 100 ml of water and 500 ml of chloroform. The organic phase was washed with a saturated aqueous solution of sodium hydrogen carbonate and then washed with a saturated aqueous sodium chloride solution, and dried with anhydrous magnesium sulfate. The chloroform was distilled off under reduced pressure, the residue was washed with n-hexane and collected by filtration to obtain 64 g of N-(2-ethylhexyl)barbituric acid.

To 40 g of N-(2-ethylhexyl)barbituric acid thus obtained was added 120 ml of phosphorus oxychloride, and then 3 ml of water was gradually added dropwise to the mixture. After refluxing by heating for 2 hours, the phosphorus oxychloride was distilled off under normal atmospheric pressure, and the residue was poured into ice water while it was still hot. The mixture was extracted three times with 200 ml of chloroform, and the organic phases were collected and dried with anhydrous magnesium sulfate. The chloroform was distilled off under reduced pressure, to the residue was added n-hexane, and the crystals thus-deposited were collected by filtration and recrystallized from ethyl acetate to obtain 32 g of 6-chloro-3-(2-ethylhexyl)uracil as yellow crystals.

To a solution containing 20 g of 6-chloro-3-(2-ethylhexyl)uracil thus obtained in 50 ml of dimethylformamide was added 11 g of potassium carbonate and then 12.1 g of methyl iodide was added thereto, and the mixture was stirred at room temperature for 1.5 hours. The reaction solution was filtered, the filtrate was poured into water and extracted twice with 100 ml of chloroform. The organic phase was washed with a saturated aqueous sodium chloride solution and dried with anhydrous magnesium sulfate. The chloroform was distilled off under reduced pressure to obtain 21 g of 6-chloro-3-(2-ethylhexyl)-1-methyluracil as an oily product.

To a solution containing 20 g of 6-chloro-3-(2-ethylhexyl)-1-methyluracil thus-obtained in 50 ml of acetonitrile was added 8.6 g of N-chlorosuccinimide, the mixture was heated to 40° C. and stirred for 2 hours. After allowing the mixture to cool, the acetonitrile was distilled off under reduced pressure, to the residue was added water and it was extracted with 100 ml of chloroform. The organic phase was washed with a saturated aqueous sodium chloride solution and dried with anhydrous magnesium sulfate. The chloroform was distilled off under reduced pressure, and the residue was purified by silica gel chromatography to obtain 22 g of 5,6-dichloro-3-(2-ethylhexyl)-1-methyluracil as an oily product.

To 20 ml of an acetonitrile solution containing 5 g of 3-mercaptopropionic acid was added dropwise 10 ml of an acetonitrile solution containing 15.8 g of 1,8-diazabicyclo[5,4,0]undecene-7 (DBU) in a nitrogen atmosphere and the mixture was stirred at room temperature for 10 minutes. Then, 15 ml of an acetonitrile solution containing 14.6 g of 5,6-dichloro-3-(2-ethylhexyl)-1-methyluracil was added dropwise thereto and the mixture was stirred at room temperature for 1 hour. The acetonitrile was distilled off under reduced pressure, to the residue were added 7 ml of concentrated hydrochloric acid and 30 ml of water and the mixture was extracted with 100 ml of chloroform. The organic phase was dried with anhydrous magnesium sulfate and then the chloroform was distilled off under reduced pressure. To the residue was added n-hexane, and the crystals thus deposited were collected by filtration to obtain 15.1 g of the desired Compound (13) as light yellow crystals. Melting Point: 114° to 116° C.

SYNTHESIS EXAMPLE 6

Synthesis of Compound (21)

To 100 ml of tetrahydrofuran solution containing 6.6 g (0.1 mol) of malononitrile was added 4.0 g (0.1 mol) of 60 wt % sodium hydride under cooling with ice, then 17 g (0.1 mol) of 6-chloro-1,3-dimethyluracil was added thereto and the mixture was stirred for 5 hours at room temperature. The reaction mixture was mixed with 100 ml of water, neutralized with concentrated hydrochloric acid, and thereafter extracted with 200 ml of ethyl acetate. The extract was dried with anhydrous sodium sulfate, the solvent was distilled off under reduced pressure, and the crystals thus-deposited were collected by filtration to obtain 12.9 g (63%) of 6-dicyanomethyl-1,3-dimethyluracil.

To 6.1 g (0.03 mol) of 6-dicyanomethyl-1,3-dimethyluracil thus obtained was added 1.5 ml of water and then 40 ml of phosphorus oxychloride was gradually added dropwise to the mixture. After refluxing by heating the mixture for 1.5 hours, the phosphorus oxychloride was distilled off under normal atmospheric pressure, and the residue was poured onto ice. The crystals thus deposited were collected by filtration. The filtrate was extracted three times with chloroform and dried with anhydrous sodium sulfate. Then, the chloroform was distilled off, the residue thus formed was mixed with the crystals collected in the aforesaid step, and the mixture was recrystallized from a mixture of water and methanol to obtain 6.15 g of 6-chloro-1,3-dimethyl-2-oxo-4-dicyanomethylenepyrimidine.

To 15 ml of an acetonitrile solution containing 4 g of 2-mercaptopropionic acid was added dropwise 10 ml of an acetonitrile solution containing 12.6 g of 1,8-diazabicyclo[5,4,0]undecene-7 (DBU) in a nitrogen atmosphere and the mixture was stirred at room temperature for 10 minutes. Then, 15 ml of an acetonitrile solution containing 8.3 g of 6-chloro-1,3-dimethyl-2-oxo-4-dicyanomethylenepyrimidine was added dropwise thereto and the mixture was stirred at room temperature for 1.5 hours. The acetonitrile was distilled off under reduced pressure, to the residue were added 6 ml of concentrated hydrochloric acid and 30 ml of water, and the mixture was extracted with 100 ml of chloroform. The organic phase was dried with anhydrous magnesium sulfate and then the chloroform was distilled off under reduced pressure. To the residue was added diethyl ether, the crystals thus-deposited were collected by filtration to obtain 7.6 g of the desired Compound (21). Melting Point: 156° to 158° C.

SYNTHESIS EXAMPLE 7

Synthesis of Compound (29)

To 15 ml of an acetonitrile solution containing 4 g of 2-mercaptoethanol was added dropwise 5 ml of an acetonitrile solution containing 6.2 g of triethylamine in a nitrogen atmosphere and the mixture was stirred at room temperature for 5 minutes. Then, 15 ml of an acetonitrile solution containing 15.8 g of 5,6-dichloro-3-(2-ethylhexyl)-1-methyluracil which was the intermediate for the synthesis of Compound (13) was added dropwise thereto and the mixture was stirred at room temperature for 1.5 hours. The acetonitrile was distilled off under reduced pressure, to the residue were added 8 ml of concentrated hydrochloric acid and 35 ml of water, and the mixture was extracted twice with 100 ml of chloroform. The organic phases were collected and dried with anhydrous magnesium sulfate. The chloroform was distilled off under reduced pressure and to the residue was added a solvent mixture of n-hexane and ethyl acetate, the crystals thus-deposited were collected by filtration to obtain 13.4 g of the desired Compound (29) as light yellow crystals. Melting Point: 152° to 154° C.

SYNTHESIS EXAMPLE 8

Synthesis of Compound (31)

To 20 ml of an acetonitrile solution containing 6 g of 2-mercaptoethanol was added dropwise 5 ml of an acetonitrile solution containing 9.3 g of triethylamine in a nitrogen atmosphere and the mixture was stirred at room temperature for 5 minutes. Then, 15 ml of an acetonitrile solution containing 16 g of 5,6-dichloro-1,3-dimethyluracil which was the intermediate for the synthesis of Compound (1) was added dropwise thereto and the mixture was stirred at room temperature for 1 hour. The acetonitrile was distilled off under reduced pressure, to the residue were added 9 ml of concentrated hydrochloric acid and 400 ml of water, and the mixture was extracted three times with 100 ml of chloroform. The organic phases were collected and dried with anhydrous magnesium sulfate and then the chloroform was distilled off under reduced pressure. To the residue was added ethyl acetate, the crystals thus-deposited were collected by filtration to obtain 14.7 g of the desired Compound (31) as white crystals. Melting Point: 168° to 171° C.

The compound according to the present invention may be added to any layer including a light-sensitive emulsion layer and a light-insensitive layer. It is preferred to incorporate it into a light-insensitive layer such as an interlayer.

The amount of the compound according to the present invention to be added is generally from about 0.01 mol % to 100 mol %, preferably from about 0.1 mol % to 50 mol %, and particularly preferably from about 1 mol % to 20 mol % based on the total coating amount of silver.

The compound according to the present invention is dissolved or dispersed using an alcohol such as methanol, water, tetrahydrofuran (THF), acetone, gelatin, a surface active agent, etc. and then added to a coating solution. Also, it can be dissolved in an organic solvent having a high boiling point, and emulsified and dispersed using a homogenizer in a manner similar to incorporation of coupler.

In the photographic emulsion layers of the photographic light-sensitive material used in the present invention, a preferably employed silver halide is silver iodobromide, silver iodochloride or silver iodochlorobromide each containing up to about 30 mol % of silver iodide. Silver iodobromide containing from about 2 mol % to about 25 mol % of silver iodide is particularly preferred.

Silver halide grains in the silver halide emulsion may have a regular crystal structure, for example, a cubic, octahedral or tetradecahedral structure, an irregular crystal structure, for example, a spherical or tabular structure, a crystal defect, for example, a twin plane, or a composite structure thereof.

The grain size of silver halide may be varied, and includes from fine grains of about 0.2 micron or less to large size grains of about 10 microns, each as the diameter of the projected area. Further, a polydisperse emulsion and a monodisperse emulsion may be used.

The silver halide photographic emulsion used in the present invention can be prepared using known methods, for example, those as described in *Research Disclosure*, No. 17643 (December, 1978), pages 22 to 23, "I.

Emulsion Preparation and Types" and ibid., No. 18716 (November, 1979), page 648.

Monodisperse emulsions as described in U.S. Pat. Nos. 3,574,628 and 3,655,394, British Patent 1,413,748, are preferably used in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, British Patent 2,112,157.

The crystal structure of the silver halide grains may be uniform, composed of different halide compositions between the inner portion and the outer portion, or may be a stratified structure.

Further, silver halide emulsions in which silver halide grains having different compositions are connected by epitaxial junctions or silver halide emulsions in which silver halide grains are connected with compounds other than silver halide such as silver thiocyanate, lead oxide, etc. may also be employed.

Moreover, a mixture of grains having a different crystal structure may be used.

The silver halide emulsions used in the present invention are usually treated by physical ripening, chemical ripening and spectral sensitization. Various additives which can be employed in these steps are described in *Research Disclosure,* No. 17643 (December, 1978) and ibid., No. 18716 (November, 1979) as summarized in the table shown below.

Further, known photographic additives which can be used in the present invention are also described in the above mentioned publications and related items are summarized in the table below.

| | Kind of Additives | RD 17643 | RD 18716 |
|---|---|---|---|
| 1. | Chemical Sensitizers | Page 23 | Page 648, right column |
| 2. | Sensitivity Increasing Agents | — | Page 648, right column |
| 3. | Spectral Sensitizers and Supersensitizers | Pages 23 to 24 | Page 648, right column to page 649, right column |
| 4. | Whitening Agents | Page 24 | — |
| 5. | Antifoggants and Stabilizers | Pages 24 to 25 | Page 649, right column |
| 6. | Light-Absorbers, Filter Dyes and Ultraviolet Ray Absorbers | Pages 25 to 26 | Page 649, right column to page 650, left column |
| 7. | Antistaining Agents | Page 25, right column | Page 650, left column to right column |
| 8. | Dye Image Stabilizers | Page 25 | — |
| 9. | Hardeners | Page 26 | Page 651, left column |
| 10. | Binders | Page 26 | Page 651, left column |
| 11. | Plasticizers and Lubricants | Page 27 | Page 650, right column |
| 12. | Coating Aids and Surfactants | Pages 26 to 27 | Page 650, right column |
| 13. | Antistatic Agents | Page 27 | Page 650, right column |

In the present invention, various color couplers can be employed and specific examples thereof are described in the patents cited in *Research Disclosure,* No. 17643, "VII-C" to "VII-G".

As yellow couplers used in the present invention, for example, those as described in U.S. Pat. Nos. 3,933,501, 4,022,620, 4,326,024 and 4,401,752, JP-B-58-10739, British Patents 1,425,020 and 1,476,760 are preferred.

As magenta couplers used in the present invention, 5-pyrazolone type and pyrazoloazole type compounds are preferred. Magenta couplers as described in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, U.S. Pat. Nos. 4,500,630 and 4,540,654 are particularly preferred.

As cyan couplers used in the present invention, phenol type and naphthol type couplers are exemplified. Cyan couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767, and European Patent 161,626A are preferred.

As colored couplers for correcting undesirable absorptions of dyes formed, those described in *Research Disclosure,* No. 17643, "VII-G", U.S. Pat. No. 4,163,670, JP-B-57-39413, U.S. Pat. Nos. 4,004,929 and 4,138,258, and British Patent 1,146,368 are preferably employed.

As couplers capable of forming appropriately diffusible dyes, those described in U.S. Pat. No. 4,366,237, British Patent 2,125,570, European Patent 96,570, and West German Patent Application (OLS) No. 3,234,533 are preferably employed.

Typical examples of polymerized dye forming couplers are described in U.S. Pat. Nos. 3,451,820, 4,080,211 and 4,367,282, British Patent 2,102,173.

Couplers capable of releasing a photographically useful residue during the course of coupling can be also employed preferably in the present invention. As DIR couplers capable of releasing a development inhibitor, those described in the patents cited in *Research Disclosure,* No. 17643, "VII-F" described above, JP-A-57-151944, JP-A-57-154234, JP-A-60-184248, and U.S. Pat. No. 4,248,962 are preferred.

As couplers which release imagewise a nucleating agent or a development accelerator at the time of development, those described in British Patents 2,097,140 and 2,131,188, JP-A-59-157638 and JP-B-59-170840 are preferred.

Furthermore, competing couplers such as those described in U.S. Pat. No. 4,130,427, poly-equivalent couplers such as those described in U.S. Pat. Nos. 4,283,472, 4,338,393 and 4,310,618, DIR redox compound releasing couplers such as those described in JP-A-60-185950 couplers capable of releasing a dye which turns to a colored form after being released such as those described in European Patent 173,302A, and the like may be employed in the photographic light-sensitive material of the present invention.

The couplers which can be used in the present invention can be introduced into the photographic light-sensitive material according to various known dispersing methods.

Suitable examples of organic solvent having a high boiling point which can be employed in an oil droplet-in-water type dispersing method are described in U.S. Pat. No. 2,322,027.

The processes and effects of latex dispersing methods and specific examples of latexes for loading are described in U.S. Pat. No. 4,199,363, West German Patent Application (OLS) Nos. 2,541,274 and 2,541,230.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be subjected to development processing in a conventional manner as described in *Research Disclosure,* No. 17643, pages 28 to 29 and ibid., No. 18716, page 651, left column to right column, as mentioned above.

A color developing solution which can be used in development processing of the color photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfates, hydrochlorides, p-toluenesulfonates thereof.

Two or more kinds of color developing agents may be employed in a combination thereof, depending on the purpose.

The color developing solution can ordinarily contain pH buffering agents, such as carbonates, borates or phosphates, of alkali metals; and development inhibitors or anti-fogging agents such as bromides, iodides, benzimidazoles, benzothiazoles, or mercapto compounds. Further, if desired, the color developing solution may contain various preservatives, such as hydroxylamine, diethylhydroxylamine, sulfites, hydrazines, phenylsemicarbazides, triethanolamine, catechol sulfonic acids, triethylenediamine(1,4-diazabicyclo[2,2,2]octane); organic solvents such as ethylene glycol, diethylene glycol; development accelerators such as benzyl alcohol, polyethylene glycol, quarternary ammonium salts, amines; dye forming couplers; competing couplers; fogging agents such as sodium boronhydride; auxiliary developing agents such as 1-phenyl-3-pyrazolidone; viscosity imparting agents; and various chelating agents represented by aminopolycarboxylic acids, aminopolyphosphonic acids, alkylphosphonic acids, and phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In case of development processing for reversal color light-sensitive materials, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol, may be employed individually or in a combination.

The pH of the color developing solution or the black-and-white developing solution is usually in a range from about 9 to 12. Further, the amount of replenishment for the developing solution can be varied depending on the color photographic light-sensitive materials to be processed, but is generally not more than about 3 liters per square meter of the photographic light-sensitive material. The amount of replenishment can be reduced to not more than about 500 ml by decreasing the bromide ion concentration in the replenisher. In the case of reducing the amount of replenishment, it is preferred to prevent evaporation and aerial oxidation of the processing solution by means of reducing the area of a processing tank which contacts with the air. Further, the amount of replenishment can be reduced by restraining accumulation of bromide ions in the developing solution.

After color development, the photographic emulsion layers are usually subjected to a bleach processing. The bleach processing can be performed simultaneously with fix processing (bleach-fix processing), or it can be performed independently from the fix processing. Further, for the purpose of rapid processing, a processing method wherein after a bleach processing a bleach-fix processing is conducted may be employed. Moreover, it may be appropriate depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), copper(II); peracids; quinones; and nitro compounds. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids (such as citric acid, tartaric acid, malic acid); persulfates; bromates; permanganates; and nitrobenzenes. Of these compounds, iron(III) complex salts of aminopolycarboxylic acids, particulary by iron(III) complex salts of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide group as described in U.S. Pat. No. 3,893,858, West German Patent 1,290,812, JP-A-53-95630, *Research Disclosure,* No. 17129 (July 1978), thiazolidine derivatives as described in JP-A-50-140129, etc.; thiourea derivatives as described in U.S.

Pat. No. 3,706,561; iodides as described in JP-A-58-16235; polyoxyethylene compounds as described in West German Patent 2,748,430; polyamine compounds as described in JP-B-45-8836 and bromide ions. Of these compounds, the compounds having a mercapto group or a disulfide group are preferred in view of their large bleach accelerating effects. Particularly, the compounds as described in U.S. Pat. No. 3,893,858, West German Patent 1,290,812 and JP-A-53-95630 are preferred. Further, the compounds described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

As fixing agents which can be employed in the fixing solution or bleach-fixing solution, thiosulfates, thiocyanates, thioether compounds, thioureas or a large amount of iodide, are typical. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be vaned in a wide range depending on characteristics of photographic light-sensitive materials (due to elements used therein, for example, couplers, etc.), uses thereof, temperature of washing water, the number of water washing tanks (stages), a replenishment system such as countercurrent or cocurrent, or other various conditions. The relationship between a number of water washing tanks and the amount of water in a multi-stage countercurrent system can be determined based on the methods described in *Journal of the Society of Motion Picture and Television Engineers,* Vol. 64, pages 248 to 253 (May, 1955).

According to the multi-stage countercurrent system described in the above publication, the amount of water for washing can be significantly reduced. However, the increase in standing time of water in a tank causes propagation of bacteria and some problems, such as adhesion of scum formed on the photographic materials. In the method of processing the silver halide color photographic material according to the present invention, a method for reducing amounts of calcium ions and magnesium ions as described in JP-A-62-288838 can be particularly effectively employed in order to solve such problems. Further, sterilizers, for example, isothiazolone compounds as described in JP-A-57-8542, cyabendazoles, chlorine type sterilizers such as sodium chloroisocyanurate, benzotriazoles, sterilizers as described in Hiroshi Horiguchi, *Bokin-Bobai No Kagaku, Biseibutsu No Mekkin-, Sakkin-, Bobai-Gijutsu,* edited by Eiseigijutsu Kai, *Bokin-Bobaizai Jiten,* edited by Nippon Bokin-Bobai Gakkai can be employed.

The pH of the washing water used in the processing of the photographic light-sensitive materials according to the present invention is usually from 4 to 9, preferably from 5 to 8. The temperature of washing water and time for the water washing step can be variously set depending on the characteristics or uses of photographic light-sensitive materials. However, it is typical to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any known methods described in JP-A-57-8543, JP-A-58-14834 and JP-A-60-220345 can be employed.

Further, it is possible to conduct the stabilizing process subsequent to the above-described water washing process. One example thereof is a stabilizing bath containing formalin and a surface active agent, which is employed as a final bath in the processing of color photographic light-sensitive materials for photographing. To such a stabilizing bath, various chelating agents and antimolds may also be added.

Overflow solutions resulted from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. Nos. 3,342,597; Schiff's base type compounds as described in U.S. Pat. No. 3,342,599 and *Research Disclosure,* No. 14850 and ibid., No. 15159; aldol compounds as described in *Research Disclosure,* No. 13924; metal salt complexes as described in U.S. Pat. No. 3,719,492; and urethane type compounds described in JP-A-53-135628.

Further, the silver halide color photographic material according to the present invention may contain, if desired, various 1-phenyl-3-pyrazolidones for the purpose of accelerating color development. Typical examples of the compounds include those described in JP-A-56-64339, JP-A-57-14454.7, and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of reducing the amount of silver employed in the color photographic light-sensitive material, the photographic processing may be conducted utilizing color intensification using cobalt or hydrogen peroxide as described in West German Patent Application (OLS) No. 2,226,770 or U.S. Pat. No. 3,674,499.

The present invention is explained in greater detail with reference to the following examples, but the present invention is not to be construed as being limited thereto. Unless otherwise indicated, all parts, percents and ratios are by weight.

EXAMPLE 1

Preparation of Sample 101

On a cellulose triacetate film support provided with a subbing layer were coated layers having the compositions shown below to prepare a multilayer color photographic light-sensitive material which was designated Sample 101.

Regarding the compositions of the layers, coated amounts of silver halide and colloidal silver are shown by a silver coated amount in units of g/m$^2$, those of couplers, additives and gelatin are shown in units of g/m$^2$, and those of sensitizing dyes are shown as molar amounts per mol of silver halide present in the same layer.

| | |
|---|---|
| First Layer: Antihalation Layer | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Second Layer: Interlayer | |
| Fine grain silver bromide (average particle size: 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Third Layer: First Red-Sensitive Emulsion Layer | |
| Silver iodobromide emulsion (silver iodide: 2 mol %; internal high silver iodide type; diameter of equivalent sphere: 0.3 μm; coefficient of variation of diameter of equivalent sphere: 29%; mixture of regular crystals and twin crystals; diameter/thickness ratio: 2.5) | 0.4 (as silver) |
| Gelatin | 0.6 |
| ExS-1 | $1 \times 10^{-4}$ |
| ExS-2 | $3 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| Fourth Layer: Second Red-Sensitive Emulsion Layer | |
| Silver iodobromide emulsion (silver iodide: 5 mol %; internal high silver iodide type; diameter of equivalent sphere: 0.7 μm; coefficient of variation of diameter of equivalent sphere: 25%; mixture of regular crystals and twin crystals; diameter/thickness ratio: 4) | 0.7 (as silver) |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| Fifth Layer: Third Red-Sensitive Emulsion Layer | |
| Silver iodobromide emulsion (silver iodide: 10 mol %; internal high silver iodide type; diameter of equivalent sphere: 0.8 μm; coefficient of variation of diameter of equivalent sphere: 16%; mixture of regular crystals and twin crystals; diameter/thickness ratio: 1.3) | 1.0 (as silver) |
| Gelatin | 1.0 |
| ExS-1 | $1 \times 10^{-4}$ |

-continued

| | |
|---|---|
| ExS-2 | $3 \times 10^{-4}$ |
| ExS-3 | $1 \times 10^{-5}$ |
| ExC-5 | 0.01 |
| ExC-6 | 0.13 |
| Solv-1 | 0.01 |
| Solv-2 | 0.05 |
| Six Layer: Interlayer | |
| Gelatin | 1.0 |
| Cpd-1 | 0.03 |
| Solv-1 | 0.05 |
| Seventh Layer: First Green-Sensitive Emulsion Layer | |
| Silver iodobromide emulsion (silver iodide: 2 mol %; internal high silver iodide type; diameter of equivalent sphere: 0.3 μm; coefficient of variation of diameter of equivalent sphere: 28%; mixture of regular crystals and twin crystals; diameter/thickness ratio: 2.5) | 0.3 (as silver) |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Eighth Layer: Second Green-Sensitive Emulsion Layer | |
| Silver iodobromide emulsion (silver iodide: 4 mol %; internal high silver iodide type; diameter of equivalent sphere: 0.6 μm; coefficient of variation of diameter of equivalent sphere: 38%; mixture of regular crystals and twin crystals; diameter/thickness ratio: 4) | 0.4 (as silver) |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| Ninth Layer: Third Green-Sensitive Emulsion Layer | |
| Silver iodobromide emulsion (silver iodide: 6 mol %; internal high silver iodide type; diameter of equivalent sphere: 1.0 μm; coefficient of variation of diameter of equivalent sphere: 80%; mixture of regular crystals and twin crystals; diameter/thickness ratio: 1.2) | 0.85 (as silver) |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Tenth Layer: Yellow Filter Layer | |
| Gelatin | 1.2 |
| Yellow colloidal silver | 0.08 |
| Cpd-2 | 0.1 |
| Solv-1 | 0.3 |
| Eleventh Layer: First Blue-Senstive Emulsion Layer | |
| Silver iodobromide emulsion (silver iodide: 4 mol %; internal high silver iodide type; diameter of equivalent sphere: 0.5 μm; coefficient of variation of diameter of equivalent sphere: 15%; octahedral grain) | 0.4 (as silver) |
| Gelatin | 1.0 |

-continued

| | |
|---|---|
| ExS-9 | $2 \times 10^{-4}$ |
| ExY-16 | 0.9 |
| ExY-14 | 0.07 |
| Solv-1 | 0.2 |
| Twelfth Layer: Second Blue-Sensitive Emulsion Layer | |
| Silver iodobromide emulsion (silver iodide: 10 mol %; internal high silver iodide type; diameter of equivalent sphere: 1.3 μm; coefficient of variation of diameter of equivalent sphere: 25%; mixture of regular crystals and twin crystals; diameter/thickness ratio: 4.5) | 0.5 (as silver) |
| Gelatin | 0.6 |
| ExS-9 | $1 \times 10^{-4}$ |
| ExY-16 | 0.25 |
| Solv-1 | 0.07 |
| Thirteenth Layer: First Protective Layer | |
| Gelatin | 0.8 |
| UV-1 | 0.1 |

-continued

| | |
|---|---|
| UV-2 | 0.2 |
| Solv-1 | 0.01 |
| Solv-2 | 0.01 |
| Fourteenth Layer: Second Protective Layer | |
| Fine grain silver bromide (average particle size: 0.07 μm) | 0.5 |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

A surface active agent was added to each of the layers as a coating aid in addition to the above described components. Thus, Sample 101 was prepared.

The chemical structural formulae or chemical names of the compounds employed in this example are shown below.

UV-1

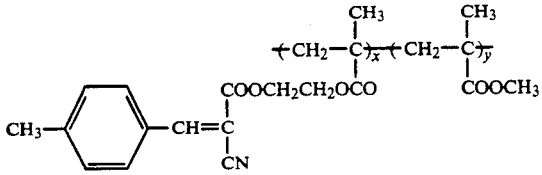

wherein x/y = 7/3 (in weight ratio)

UV-2

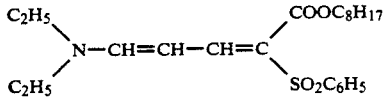

Solv-1: Tricresyl phosphate
Solv-2: Dibutyl phthalate
Solv-3: Bis(2-ethylhexyl)phthalate ExM-8

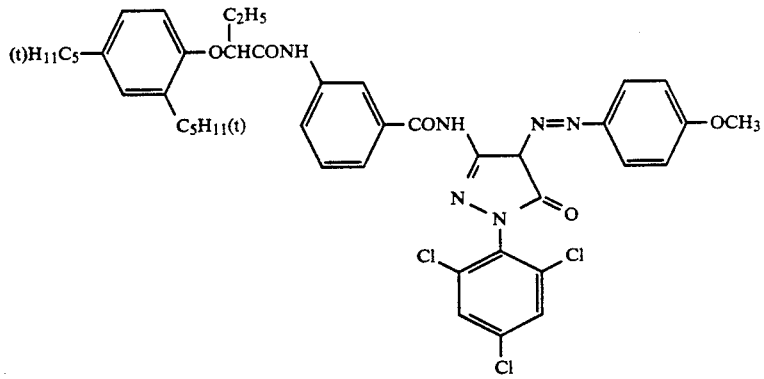

ExF-1

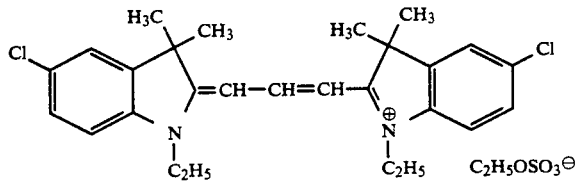

ExC-2

-continued
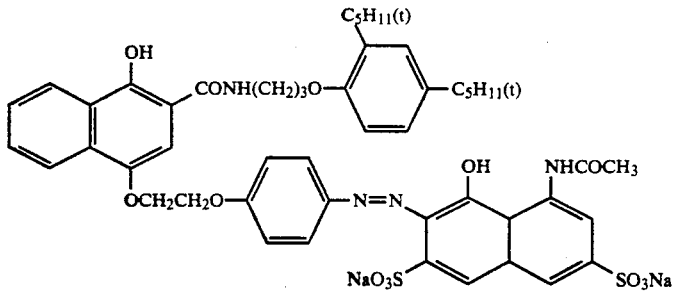
ExC-3
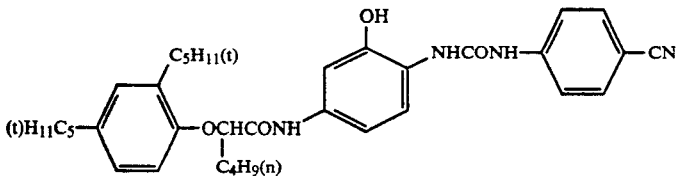
ExC-4
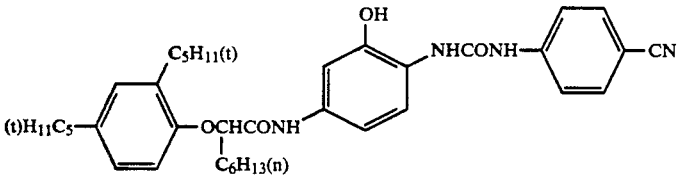
ExY-14
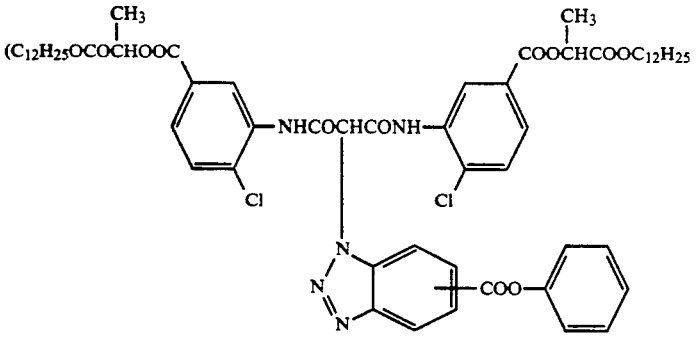
ExY-15
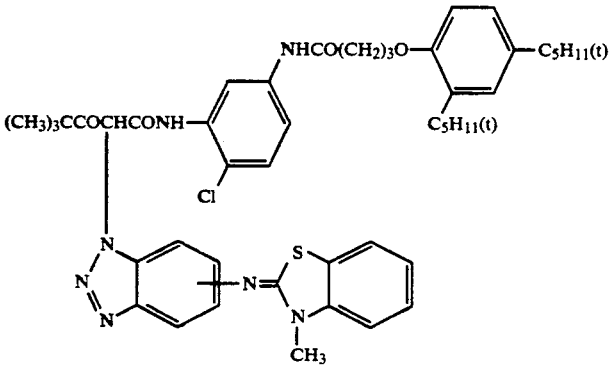
ExC-5

-continued
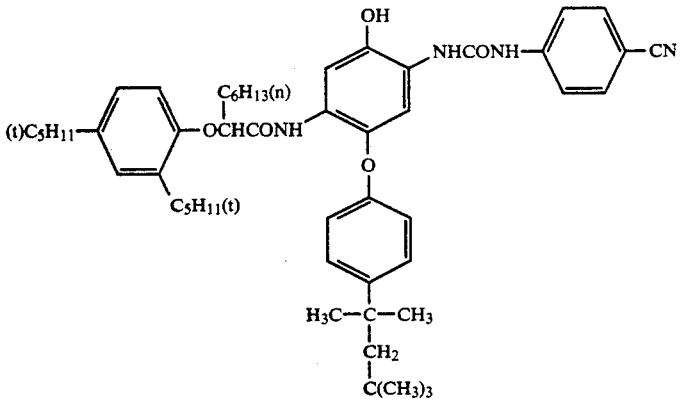
ExC-6
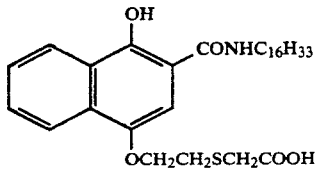
ExC-7
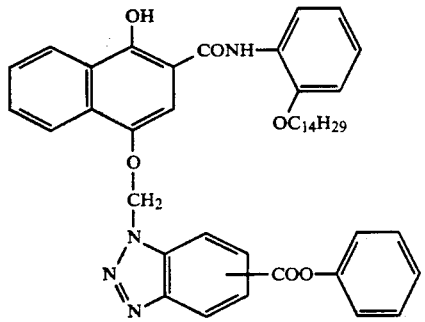
ExM-9
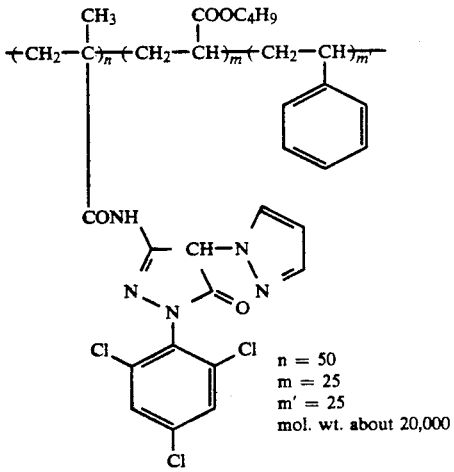
ExM-10

-continued
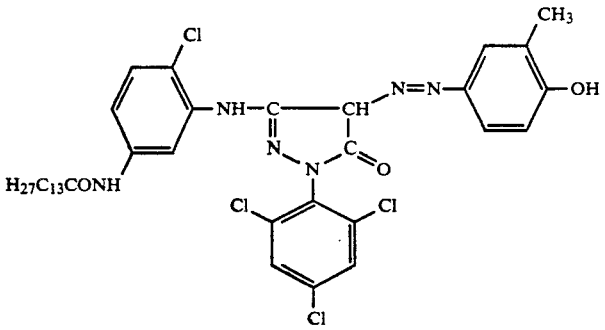
ExM-11
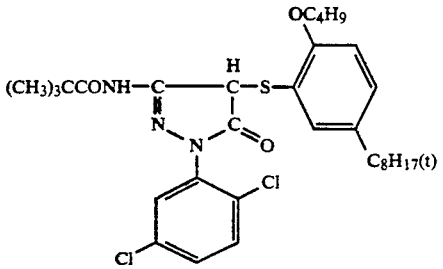
ExM-12
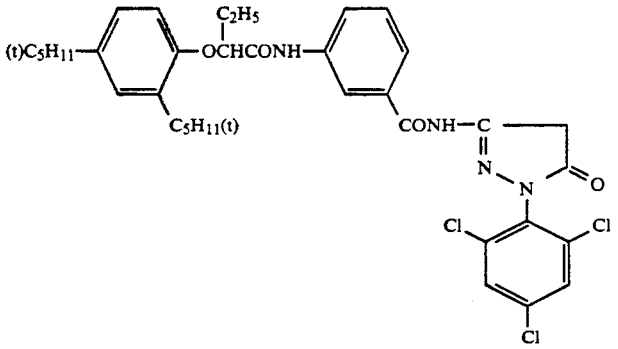
ExM-13
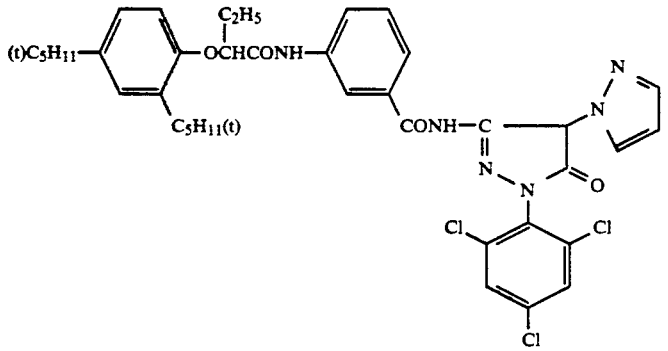
ExY-16

-continued
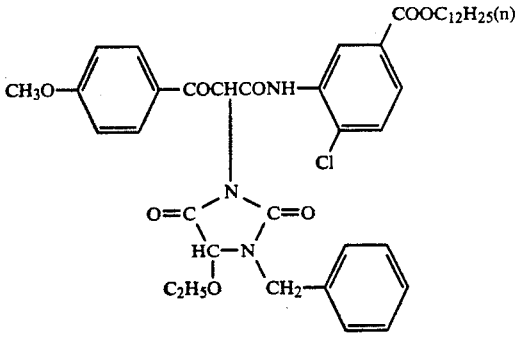
Cpd-1
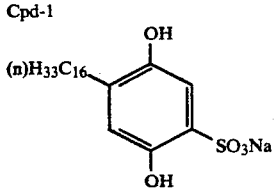
Cpd-2
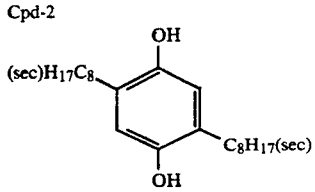
ExS-1
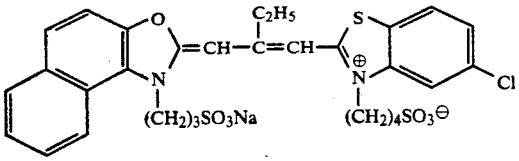
ExS-2
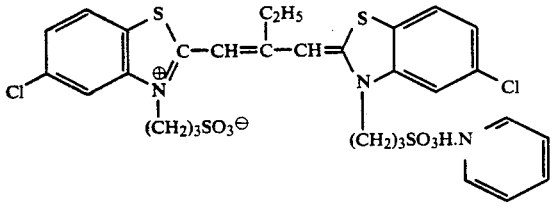
ExS-3
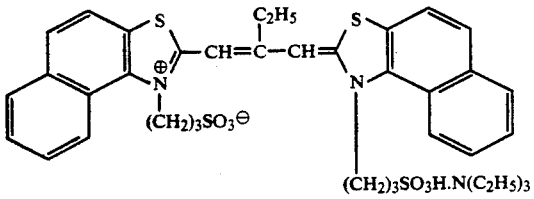
ExS-4
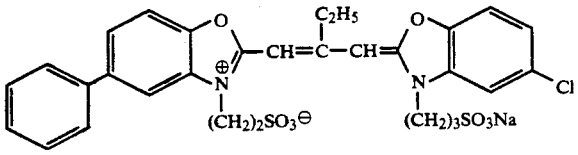
ExS-5

-continued

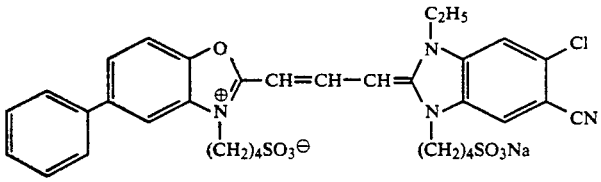

ExS-6

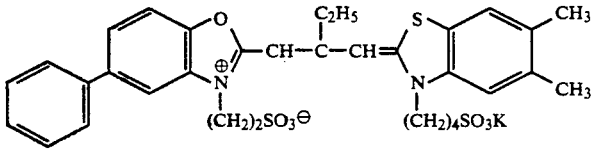

ExS-7

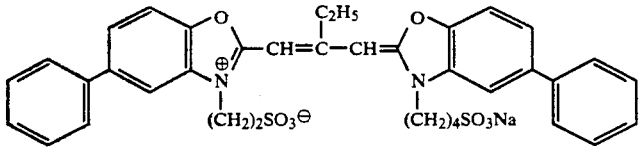

ExS-8

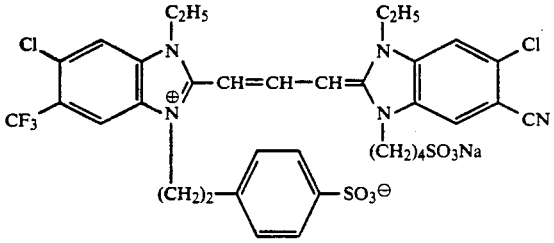

ExS-9

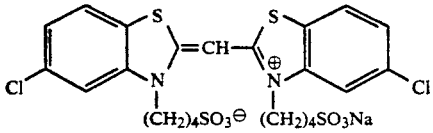

H-1

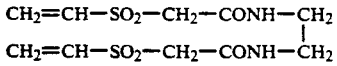

Cpd-3

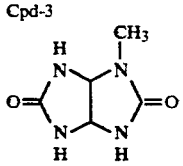

Cpd-4

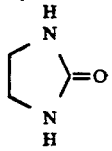

Preparation of Samples 102 and 103

Samples 102 and 103 were prepared in the same manner as described for Sample 101 except using Comparative Compounds A and B in place of ExC-6 added to the fifth layer of Sample 101, respectively.

Preparation of Samples 104 and 115

Samples 104 to 115 were prepared in the same manner as described for Sample 101 except adding an equimolar amount (to ExC-6) of Comparative Compounds C, D, E and F and the compounds according to the present invention as shown in Table 1 below to the fifth layer of Sample 101, respectively.

Comparative Compound A:

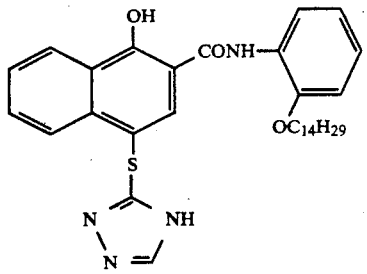

(the compound described in Research Disclosure, No. 11449 (1973))

Comparative Compound B:

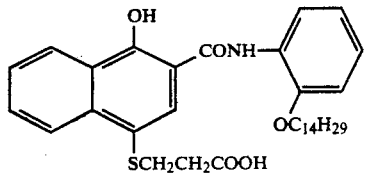

Comparative Compound C:

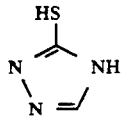

Comparative Compound D:

$HSCH_2CH_2COOH$

Comparative Compound E:

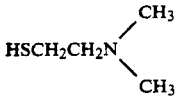

Comparative Compound F:

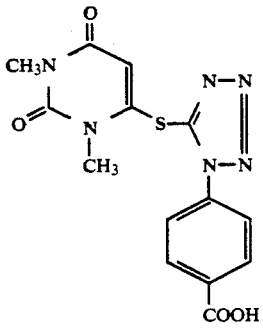

Samples 101 to 115 thus obtained were cut into strips of 35 m/m width, used to photograph standard subjects and subjected to a running test according to Processing Steps (I), (II) or (III) shown below with a 500 m length After the running test, other strips of Samples 101 to 115 were exposed to white light of 20 CMS through a step wedge and then subjected to the development processing according to Processing Steps (I), (II) or (III) shown below.

The amount of remaining silver in the maximum density area of each sample thus-processed was determined according to X-ray fluorometric analysis. The results obtained are shown in Table 1 below.

Further, in order to determine stability during preservation of Samples 101 to 115 before exposure to light, each sample was stored under conditions of 45° C. and 80% RH for 1 week and then subjected to the wedge exposure and development processing according to Processing Step (II) in the same manner as described above to evaluate changes in photographic characteristics. The results obtained are also shown in Table 1 below.

It is preferred that the amount of remaining silver is small and the sensitivity of red-sensitive layer and decrease in sensitivity after preservation are near 0.

From these results shown in Table 1 below, it can be seen that the samples according to the present invention exhibited sufficiently high silver removal accelerating effect even in the running conditions and were excellent in stability during preservation On the other hand, each of Comparative Compounds C, D, E and F was added to the bleach-fixing solution of Processing Step (III). Using the bleach-fixing solution, Sample 101 was subjected to running processing and thereafter another strip of Sample 101 was subjected to wedge exposure and development processing in the same manner as described above to determine the amount of remaining silver. From the results, it is apparent that these comparative compounds exhibited only slight silver removal accelerating effect in comparison with the cases wherein the comparative compounds were not added to the bleach-fixing solution.

Processing Step (I): [Processing Temperature: 38° C.]

| Processing Step | Processing Time | Amount of Replenishment* |
|---|---|---|
| Color Development | 3 min. 15 sec. | 15 ml |
| Bleaching | 3 min. 00 sec | 5 ml |
| Fixing | 4 min. 00 sec. | 30 ml |
| Stabilizing (1) | 30 sec. | — |
| Stabilizing (2) | 30 sec. | — |
| Stabilizing (3) | 30 sec. | 30 ml |
| Drying | 1 min. 30 sec. (at 50° C.) | — |

*Amount of replenishment per 1 meter of a 35 m/m width strip

In the above described processing steps, the stabilizing steps (1), (2) and (3) were carried out using a countercurrent stabilizing system of (3)→(2) →(1). Further, the amount of fixing solution carried over to the stabilizing tank was 2 ml per meter of the strip.

The composition of each processing solution used is illustrated below.

| Color Developing Solution: | Mother (Tank Liquor Solution) | Replenisher |
|---|---|---|
| Diethylenetriaminepenta-acetic Acid | 1.0 g | 2.0 g |
| 1-Hydroxyethylidene-1,1-diphosphonic Acid | 2.0 g | 3.3 g |
| Sodium Sulfite | 4.0 g | 5.0 g |
| Potassium Carbonate | 30.0 g | 38.0 g |
| Potassium Bromide | 1.4 g | — |
| Potassium Iodide | 1.3 mg | — |
| Hydroxylamine | 2.4 g | 3.2 g |

-continued

| | | |
|---|---|---|
| 4-(N-Ethyl-N-β-hydroxy-ethylamino)-2-methyl-aniline Sulfate | 4.5 g | 7.2 g |
| Water to make | 1 l | 1 l |
| pH | 10.00 | 10.05 |

| | Mother Liquor | Replenisher |
|---|---|---|
| Bleaching Solution: | | |
| Ammonium Iron (III) Ethylenediaminetetra-acetate | 50 g | 60 g |
| Ammonium Iron (III) 1,3-Diaminopropanetetra-acetate | 60 g | 72 g |
| Aqueous Ammonia 27% (weight/weight) | 7 ml | 5 ml |
| Ammonium Nitrate | 10.0 g | 12.0 g |
| Ammonium Bromide | 150 g | 170 g |
| Water to make | 1 l | 1 l |
| pH | 6.0 | 5.8 |
| Fixing Solution: | | |
| Disodium Ethylenediamine-tetraacetate | 1.0 g | 1.2 g |
| Sodium Sulfite | 4.0 g | 5.0 g |
| Sodium Bisulfite | 4.6 g | 5.8 g |
| Ammonium Thiosulfate (700 g/l aq. soln.) | 175 ml | 200 ml |
| Water to make | 1.0 l | 1.0 l |
| pH | 6.6 | 6.6 |
| Stabilizing Solution: | | |
| Formalin (37% weight/volume) | 2.0 ml | 3.0 ml |
| Polyoxyethylene-p-monononylphenylether (average degree of polymerization: 10) | 0.3 g | 0.45 g |
| 5-Chloro-2-methyl-4-iso-thiazolin-3-one | 0.03 g | 0.045 g |
| Water to make | 1.0 l | 1.0 l |

Processing Step (II): [Processing Temperature: 38° C.]

| Processing Step | Processing Time | Amount of Replenishment* |
|---|---|---|
| Color Development | 3 min. 15 sec. | 15 ml |
| Bleaching | 1 min. 00 sec. | 10 ml |
| Bleach-Fixing | 3 min. 15 sec. | 15 ml |
| Washing with Water (1) | 40 sec. | — |
| Washing with Water (2) | 1 min. 00 sec. | 1200 ml |
| Stabilizing | 20 sec. | 15 ml |
| Drying | 1 min. 15 sec. (at 60° C.) | — |

*Amount of replenishment per 1 meter of a 35 m/m width strip

In the above described processing steps, the washing with water steps (1) and (2) were carried out using a countercurrent water washing system from Washing with Water (2) to Washing with Water (1).

The composition of each processing solution used is illustrated below.

| | Mother Liquor | Replenisher |
|---|---|---|
| Color Developing Solution: | | |
| Diethylenetriaminepenta-acetic Acid | 1.0 g | 1.1 g |
| 1-Hydroxyethylidene-1,1-diphosphonic Acid | 2.0 g | 2.2 g |
| Sodium Sulfite | 4.0 g | 4.9 g |
| Potassium Carbonate | 30.0 g | 42.0 g |
| Potassium Bromide | 1.6 g | — |
| Potassium Iodide | 2.0 mg | — |
| Hydroxylamine | 2.4 g | 3.6 g |
| 4-(N-Ethyl-N-β-hydroxy-ethylamino)-2-methyl-aniline Sulfate | 5.0 g | 7.3 g |
| Water to make | 1.0 l | 1.0 l |
| pH | 10.00 | 10.05 |

| Bleaching Solution: (both Mother Liquor and Replenisher) | |
|---|---|
| Ammonium Iron (III) Ethylene-diaminetetraacetate | 120.0 g |
| Disodium Ethylenediaminetetra-acetate | 10.0 g |
| Ammonium Nitrate | 10.0 g |
| Ammonium Bromide | 100.0 g |
| Adjusted pH to 6.3 with aqueous ammonia | |
| Water to make | 1.0 l |
| Bleach-Fixing Solution: (both Mother Liquor and Replenisher) | |
| Ammonium Iron (III) Ethylene-diaminetetraacetate | 50.0 g |
| Disodium Ethylenediaminetetra-acetate | 5.0 g |
| Sodium Sulfite | 12.0 g |
| Aqueous Solution of Ammonium Thiosulfate (700 g/l) | 240.0 ml |
| adjusted pH to 7.3 with aqueous ammonia | |
| Water to make | 1.0 l |

Washing Water:

City water which was passed through a column filled with an Na type strong acidic cation exchange resin (Diaion SK-1B manufactured by Mitsubishi Chemical Industries Ltd.) to prepare water having the water quality of calcium: 2 mg/l and magnesium: 1.2 mg/l was employed.

Stabilizing Solution:

Same as described in Processing Step (I).

Processing Step (III): [Processing Temperature: 38° C.]

| Processing Step | Processing Time | Capacity of Tank | Amount of Replenishment* |
|---|---|---|---|
| Color Development | 3 min. 15 sec. | 8 l | 15 ml |
| Bleach-Fixing | 2 min. 30 sec. | 8 l | 25 ml |
| Washing With Water (1) | 20 sec. | 4 l | Three-stage countercurrent system |
| Washing With Water (2) | 20 sec. | 4 l | |
| Washing With Water (3) | 20 sec. | 4 l | 10 ml |
| Stabilizing | 20 sec. | 4 l | 10 ml |

*Amount of replenishment per 1 meter of a 35 m/m width strip

In the above described processing steps, the washing with water steps (1), (2) and (3) were carried out using a three-stage countercurrent washing with water system of (3)→(2)→(1).

The composition of each processing solution used is illustrated below.

| | Mother Liquor | Replenisher |
|---|---|---|
| Color Developing Solution: | | |
| Diethylenetriaminepenta-acetic Acid | 1.0 g | 1.2 g |
| 1-Hydroxyethylidene-1,1-diphosphonic Acid | 2.0 g | 2.4 g |
| Sodium Sulfite | 2.0 g | 4.8 g |
| Potassium Carbonate | 35.0 g | 45.0 g |
| Potassium Bromide | 1.6 g | — |
| Potassium Iodide | 2.0 mg | — |
| Hydroxylamine | 2.0 g | 3.6 g |
| 4-(N-Ethyl-N-β-hydroxy-ethylamino)-2-methyl-aniline Sulfate | 5.0 g | 7.5 g |
| Water to make | 1 l | 1 l |

-continued

| | Mother Liquor | Replenisher |
|---|---|---|
| Adjusted pH with potassium hydroxide to | 10.20 | 10.35 |
| Bleach-Fixing Solution: | | |
| Iron (III) Ammonium Ethylenediaminetetra-acetate | 40 g | 45 g |
| Iron (III) Ammonium Diethylenetriaminepenta-acetate | 40 g | 45 g |
| Disodium Ethylenediamine-tetraacetate | 10 g | 10 g |
| Sodium Sulfite | 15 g | 20 g |
| Ammonium Thiosulfate (700 g/l aq. soln.) | 240 ml | 270 ml |
| Aqueous Ammonia 26% (weight/weight) | 14 ml | 12 ml |
| Water to make | 1 l | 1 l |
| pH | 6.7 | 6.5 |

Washing Water:

The following three kinds of washing water were employed.

[1] City Water

| | |
|---|---|
| Calcium | 26 mg/l |
| Magnesium | 9 mg/l |
| pH | 7.2 |

[2] Ion Exchanged Water

The above described city water was treated with an Na-type strong acidic cation exchange resin manufactured by Mitsubishi Chemical Industries Ltd. to prepare water having the following water quality:

| | |
|---|---|
| Calcium | 1.1 mg/l |
| Magnesium | 0.5 mg/l |
| pH | 6.6 |

[3] City Water Containing Chelating Agent

To the above described city water, was added disodium ethylenediaminetetraacetate in an amount of 500 mg per liter.

| | |
|---|---|
| pH | 6.7 |

TABLE 1

| Sample No. | Compound Added to Fifth Layer | Amount of Remaining Silver: Processing Step (I) (mg/m$^2$) | Processing Step (II) (mg/m$^2$) | Processing Step (III) (mg/m$^2$) | Sensitivity of* Red-Sensitive Layer | Decrease in Sensitivity** after Preservation at 45° C., 80% RH for 1 Week |
|---|---|---|---|---|---|---|
| 101 (Comparison) | none | 43 | 80 | 140 | ±0 | −0.03 |
| 102 (Comparison) | A | 36 | 61 | 113 | +0.02 | −0.10 |
| 103 (Comparison) | B | 28 | 36 | 52 | +0.03 | −0.13 |
| 104 (Comparison) | C | 42 | 79 | 135 | −0.18 | 0.15 |
| 105 (Comparison) | D | 12 | 14 | 26 | −0.22 | 0.16 |
| 106 (Comparison) | E | 8 | 9 | 16 | −0.26 | −0.20 |
| 107 (Comparison) | F | 40 | 79 | 138 | −0.04 | −0.06 |
| 108 (Present Invention) | (1) | 24 | 26 | 28 | −0.03 | −0.04 |
| 109 (Present Invention) | (13) | 20 | 24 | 28 | −0.03 | −0.03 |
| 110 (Present Invention) | (22) | 18 | 25 | 26 | −0.02 | −0.04 |
| 111 (Present Invention) | (24) | 21 | 26 | 29 | −0.01 | −0.04 |
| 112 (Present Invention) | (27) | 21 | 26 | 28 | −0.01 | −0.02 |
| 113 (Present Invention) | (28) | 20 | 25 | 29 | −0.01 | −0.03 |
| 114 (Present Invention) | (6) | 22 | 25 | 27 | −0.02 | −0.03 |
| 115 (Present Invention) | (21) | 21 | 26 | 29 | −0.01 | −0.06 |

*log E at the point having density of fog + 0.2. Sample 101 was used as a standard.

**Difference between sensitivity of sample preserved at 45° C. and 80% RH for 1 week and sensitivity of sample preserved in a refrigerator 5° C. for 1 week.

EXAMPLE 2

Sample 201

On a cellulose triacetate film support provided with a subbing layer was coated each layer having the composition set forth below to prepare a multilayer color photographic light-sensitive material which was designated as Sample 201.

With respect to the compositions of the layers, coated amounts of silver halide and colloidal silver are shown in g/m$^2$ units of silver, the coated amounts of couplers, additives and gelatin are shown in g/m$^2$ units, and the coated amounts of sensitizing dyes are shown as mol number per mol of silver halide present in the same layer.

| | |
|---|---|
| First Layer: Antihalation Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low-Sensitive Red Sensitive Emulsion Layer | |
| Silver iodobromide emulsion (AgI: 4 mol %, uniform AgI type, diameter corresponding to sphere: 0.5 μm, coefficient of variation of diameter corresponding to sphere: 20%, tabular grain, diameter/thickness ratio: 3.0) | 1.2 (as silver) |
| Silver iodobromide emulsion (AgI: 3 mol %, uniform AgI type, diameter corresponding to sphere: 0.3 μm, coefficient of variation of diameter corresponding to sphere: 15%, spherical grain, diameter/thickness ratio: 1.0) | 0.6 (as silver) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High-Sensitive Red-sensitive Emulsion Layer | |
| Silver iodobromide emulsion (AgI: 6 mol %, internal high AgI type with core/shell ratio of 1/1, diameter corresponding to sphere: 0.7 μm, coefficient of variation of diameter corresponding to sphere: 15%, tabular grain, diameter/thickness ratio: 5.0) | 0.7 (as silver) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.5 |
| Cpd-1 | 0.1 |
| Solv-1 | 0.05 |
| Sixth Layer: Low-Sensitive Green-Sensitive Emulsion Layer | |
| Silver iodobromide emulsion (AgI: 4 mol %, surface high AgI type with core/shell ratio of 1/1, diameter corresponding to sphere: 0.5 μm, coefficient of variation of diameter corresponding to sphere: 15%, tabular grain, diameter/thickness ratio: 4.0) | 0.35 (as silver) |
| Silver iodobromide emulsion (AgI: 3 mol %, uniform AgI type, diameter corresponding to sphere: 0.3 μm, coefficient of variation of diameter corresponding to sphere: 25%, spherical grain, diameter/thickness ratio: 1.0) | 0.20 (as silver) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High-Sensitive Green-sensitive Emulsion Layer | |
| Silver iodobromide emulsion (AgI: 4 mol %, internal high AgI type with core/shell ratio of 1/3, diameter corresponding to sphere: 0.7 μm, coefficient of variation of diameter corresponding to sphere: 20%, tabular grain, diameter/thickness ratio: 5.0) | 0.8 (as silver) |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-2 | 0.02 |
| Ninth Layer: Donor Layer for Interimage Effect to Red-Sensitive Layer | |
| Silver iodobromide emulsion (AgI: 2 mol %, internal high AgI type with core/shell ratio of 2/1, diameter corresponding to sphere: 1.0 μm, coefficient of variation of diameter corresponding to sphere: 15%, tabular grain, diameter/thickness ratio: 6.0) | 0.35 (as silver) |
| Silver iodobromide emulsion (AgI: 2 mol %, internal high AgI type with core/shell ratio of 1/1, diameter corresponding to sphere: 0.4 μm, coefficient of variation of diameter corresponding to sphere: 20%, tabular grain, diameter/thickness ratio: 6.0) | 0.20 (as silver) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow colloidal silver | 0.05 |
| Gelatin | 0.5 |
| Cpd-2 | 0.13 |
| Cpd-1 | 0.10 |
| Eleventh Layer: Low-Sensitive Blue-Sensitive Emulsion Layer | |
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 25%, tabular grain, diameter/thickness ratio: 7.0) | 0.15 (as silver) |

-continued

| | |
|---|---|
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer: High-Sensitive Blue-Sensitive Emulsion Layer | |
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |

-continued

| | |
|---|---|
| UV-4 | 0.1 |
| UV-5 | 0.15 |
| Solv-1 | 0.01 |
| Solv-2 | 0.01 |
| Fourteenth Layer: Second Protective Layer | |
| Fine grain silver iodobromide emulsion (AgI: 2 mol %, uniform AgI type, diameter corresponding to sphere: 0.07 μm) | 0.5 (as silver) |
| Gelatin | 0.45 |
| Polymethyl methacrylate particles (diameter: 1.5 μm) | 0.2 |
| H-1 | 0.4 |
| Cpd-3 | 0.5 |
| Cpd-4 | 0.5 |

Each layer described above further contained a stabilizer for emulsion (Cpd-3: 0.04 g/m$^2$) and a surface active agent (Cpd-4: 0.02 g/m$^2$) as a coating aid in addition to the above described compounds. Further, compounds (Cpd-5: 0.5 g/m$^2$, Cpd-6: 0.5 g/m$^2$) were added to each layer.

The compounds used for the preparation of Sample 201 are illustrated below.

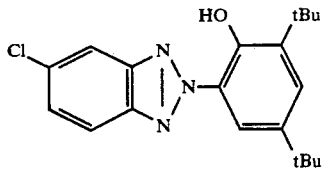

UV-1

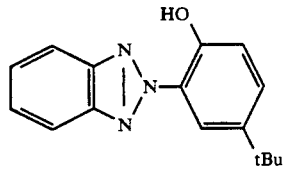

UV-2

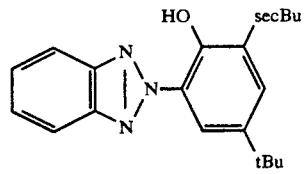

UV-3

Same as UV-1 in Example 1. UV-4

Same as UV-2 in Example 1. UV-5

Tricresyl phosphate Solv-1

Dibutyl phthalate Solv-2

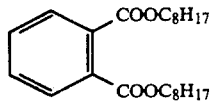

Solv-3

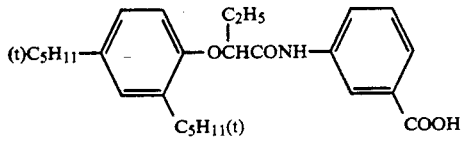

Solv-4

-continued
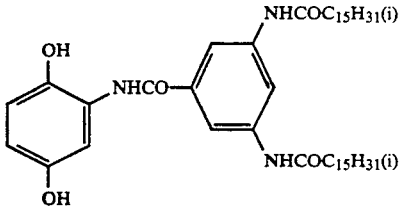
Cpd-1
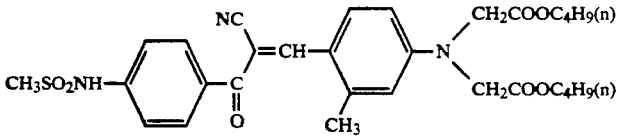
Cpd-2
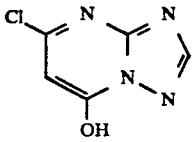
Cpd-3
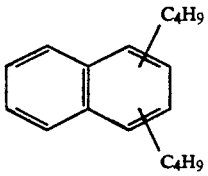
Cpd-4
Same as Cpd-3 in Example 1. Cpd-5
Same as Cpd-4 in Example 1. Cpd-6
Same as ExC-3 in Example 1. ExC-1
ExC-2
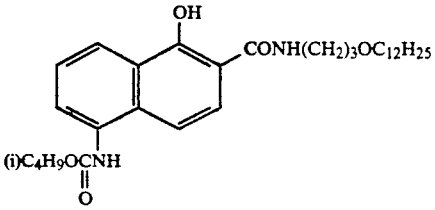
ExC-3
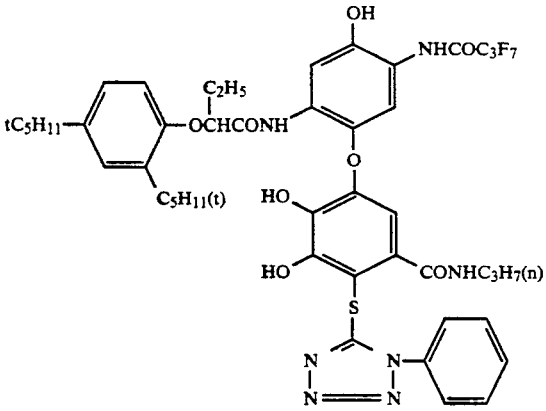
Same as ExC-2 in Example 1. ExC-4
Same as ExC-7 in Example 1. ExC-5
Same as ExC-5 in Example 1. ExC-6
ExC-7
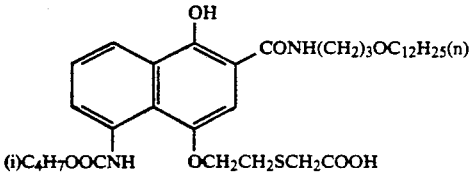

-continued
Same as ExM-9 in Example 1. ExM-8
ExM-9
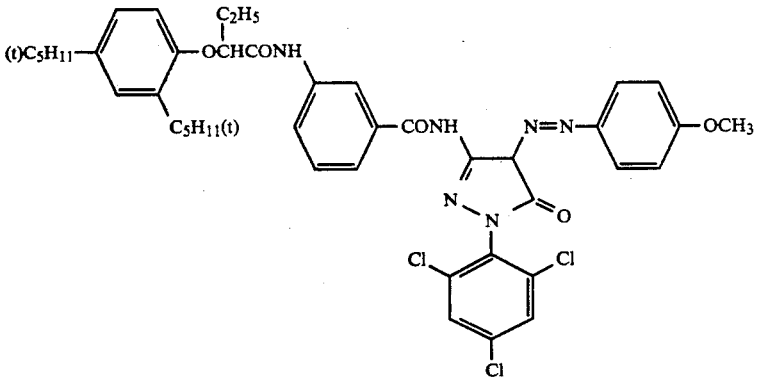
Same as ExM-10 in Example 1. ExM-10
Same as ExY-15 in Example 1. ExY-11
ExM-12
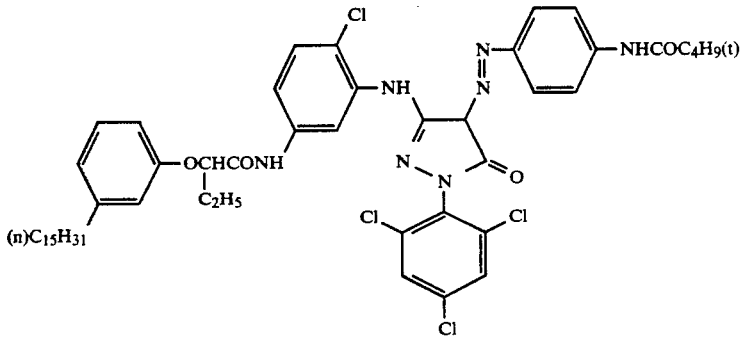
Same as ExY-14 in Example 1. ExY-13
Same as ExM-13 in Example 1. ExM-14
Same as ExY-16 in Example 1. ExY-15
ExC-16
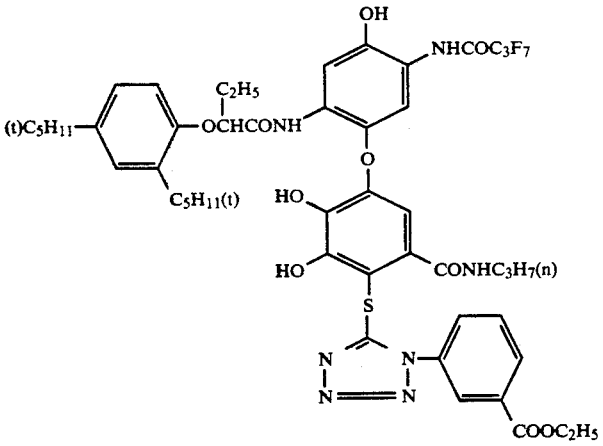
ExY-17
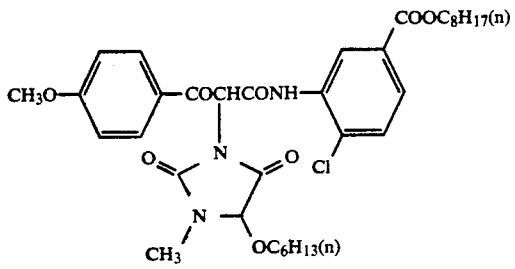
Same as ExS-1 in Example 1. ExS-1

-continued

Same as ExS-2 in Example 1. ExS-2

ExS-3

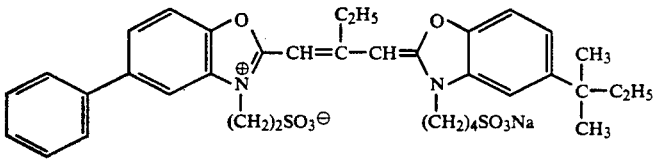

Same as ExS-4 in Example 1. ExS-4
Same as ExS-6 in Example 1. ExS-5
Same as ExS-9 in Example 1. ExS-6
Same as H-1 in Example 1. H-1

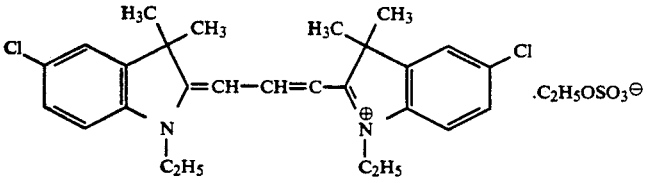

Samples 202 to 215

Samples 202 to 215 were prepared in the same manner as described for Sample 201 except adding the compounds as described in Table 2 shown below to the second layer of Sample 201 in an amount of $2\times10^{-4}$ mol/m$^2$, respectively.

These samples thus prepared were subjected to the running processing according to Processing Step (III) in the same manner as described in Example 1. Then, other strips were subjected to wedge exposure and development processing in the same manner as described in Example 1. After the processing, the amount of remaining silver in each sample was measured. The results obtained are shown in Table 2 below.

From the results shown in Table 2 below, it is apparent that the compounds according to the present invention exhibited sufficiently high silver removal accelerating effect when added to a light-insensitive interlayer.

TABLE 2

| Sample No. | Compound Added to Second Layer | Amount of Remaining Silver | Sensitivity of* Red-Sensitive Layer |
|---|---|---|---|
| 201 (Comparison) | none | 120 | ±0 |
| 202 (Comparison) | A | 100 | +0.01 |
| 203 (Comparison) | B | 90 | +0.01 |
| 204 (Comparison) | C | 46 | −0.03 |
| 205 (Comparison) | D | 18 | −0.21 |
| 206 (Comparison) | E | 15 | −0.25 |
| 207 (Comparison) | F | 116 | −0.04 |
| 208 (Present Invention) | (1) | 23 | −0.02 |
| 209 (Present Invention) | (13) | 21 | −0.03 |
| 210 (Present Invention) | (22) | 26 | ±0 |
| 211 (Present Invention) | (24) | 26 | −0.02 |
| 212 (Present Invention) | (27) | 24 | ±0 |
| 213 (Present Invention) | (28) | 20 | ±0 |
| 214 (Present Invention) | (6) | 23 | −0.01 |
| 215 (Present Invention) | (21) | 24 | −0.02 |

*Evaluated in the same manner as described in Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one of a silver halide emulsion layer and other hydrophilic colloid layers, wherein the silver halide emulsion layer or the hydrophilic colloid layer contains at least one compound represented by formula (II):

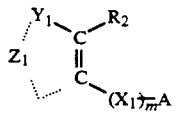

(II)

wherein $Z_1$ represents an atomic group necessary for forming a carbocyclic ring or a heterocyclic ring; $R_2$ represents a hydrogen atom or a group that can be substituted; $Y_1$ represents

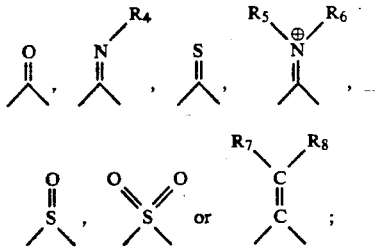

$R_4$, $R_5$, $R_6$, $R_7$ and $R_8$, which may be the same or different, each represents a hydrogen atom or a group that can be substituted; $X_1$ represents a divalent linking group containing a hetero atom connected to the carbon atom; m is 0 or 1; A represents a bleach accelerating agent moiety represented by

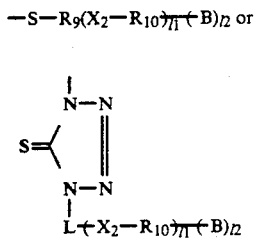

wherein $R_9$ represents a divalent, trivalent or tetravalent aliphatic group having from 1 to 8 carbon atoms or

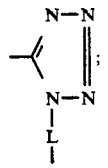

L represents a divalent, trivalent or tetravalent aliphatic group having from 1 to 8 carbon atoms; $X_2$ represents an oxygen atom, a sulfur atom,

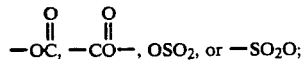

$R_{10}$ represents a divalent, trivalent or tetravalent aliphatic group having 1 to 8 carbon atoms; B represents a group selected from the group consisting of —COOM, —$COOCH_3$, —$COOC_2H_5$,

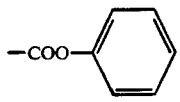

and —OH, wherein M represents a hydrogen atom, an alkali metal atom, a quaternary ammonium group, or a quaternary phosphonium group; $l_1$ is 0, 1, 2 or 3, provided that when $l_1$ is 2 or 3, the plural $X_2$-$R_{10}$ groups may be the same or different; and $l_2$ is 1, 2 or 3, provided that when $l_2$ is 2 or 3, the plural B groups may be the same or different; and wherein an amount of the compound represented by formula (II) to be added is from 0.01 mol % to 100 mol % based on the total amount of said silver.

2. A silver halide color photographic material as claimed in claim 1, wherein $R_2$ represents a hydrogen atom, a halogen atom, an alkyl group, an aryl group, an alkoxy group, an aryloxy group, an alkylthio group, an arylthio group, an acyloxy group, an amino group, a carbonamide group, a ureido group, a carboxy group, a carbonic acid ester group, an oxycarbonyl group, a carbamoyl group, an acyl group, a sulfo group, a sulfonyl group, a sulfinyl group, a sulfamoyl group, a cyano group or a nitro group.

3. A silver halide color photographic material as claimed in claim 2, wherein each $R_2$ other than hydrogen is further substituted with at least one substituent selected from the group consisting of a halogen atom, an alkyl group, an aryl group, an alkoxy group, an aryloxy group, an alkylthio group, an arylthio group, an acyl group, an acylamino group, a nitro group, a cyano group, an oxycarbonyl group, a hydroxyl group, a carboxyl group, a sulfo group, a ureido group, a sulfonamide group, a sulfamoyl group, a carbamoyl group, an acyloxy group, an amino group, a carbonic acid ester group, a sulfone group and a sulfinyl group.

4. A silver halide color photographic material as claimed in claim 1, wherein $R_4$, $R_5$, $R_6$, $R_7$ and $R_8$ each represents hydrogen atom, an alkyl group, an alkenyl group, an aryl group, an alkoxy group, an aryloxy group, an acyloxy group, an amino group, a carbonamido group, a ureido group, an oxycarbonyl group, a carbamoyl group, an acyl group, a sulfonyl group, a sulfinyl group, a sulfamoyl group, a cyano group or a nitro group.

5. A silver halide color photographic material as claimed in claim 4, wherein $R_7$ and $R_8$ each represents an oxycarbonyl group, a carbamoyl group, an acyl group, a sulfonyl group, a sulfamoyl group, a sulfinyl group, a cyano group or a nitro group.

6. A silver halide color photographic material as claimed in claim 4, wherein each $R_4$, $R_5$, $R_6$, $R_7$ and $R_8$ other than hydrogen is further substituted with at least one substituent selected from the group consisting of a halogen atom, an alkyl group, an aryl group, an alkoxy group, an aryloxy group, an alkylthio group, an arylthio group, an acyl group, an acylamino group, a nitro group, a cyano group, an oxycarbonyl group, a hydroxyl group, a carboxyl group, a sulfo group, a ureido group, a sulfonamide group, a sulfamoyl group, a carbamoyl group, an acyloxy group, an amino group, a carbonic acid ester group, a sulfone group and a sulfinyl group.

7. A silver halide color photographic material as claimed in claim 1, wherein the divalent, trivalent or tetravalent aliphatic group having from 1 to 8 carbon atoms is a saturated straight chain, branched chain or cyclic aliphatic group, or an unsaturated straight chain, branched chain or cyclic aliphatic group.

8. A silver halide color photographic material as claimed in claim 1, wherein said carbocyclic ring is a 5-membered, 6-membered or 7-membered carbocyclic ring, or a condensed ring containing said carbocyclic ring; and said heterocyclic ring is a 5-membered, 6-membered or 7-membered heterocyclic ring containing at least one nitrogen atom, oxygen atom or sulfur atom, or a condensed ring containing said heterocyclic ring.

9. A silver halide color photographic material as claimed in claim 1, wherein the carbocyclic ring or heterocyclic ring is substituted with at least one substituent selected from the group consisting of a halogen atom, an alkyl group, an aryl group, an alkoxy group, an aryloxy group, an alkylthio group, an arylthio group, an acyl group, an acylamino group, a nitro group, a cyano group, an oxycarbonyl group, a hydroxyl group, a carboxyl group, a sulfo group, a ureido group, a sulfonamide group, a sulfamoyl group, a carbamoyl group, an acyloxy group, an amino group, a carbonic acid ester group, a sulfone group and a sulfinyl group.

10. A silver halide color photographic material as claimed in claim 1, wherein the compound represented by formula (II) is present in a light-sensitive emulsion layer.

11. A silver halide color photographic material as claimed in claim 1, wherein the compound represented by formula I(I) is present in a light-insensitive layer.

12. A silver halide color photographic material as claimed in claim 1, wherein said silver halide in the light-sensitive emulsion layer is silver iodobromide containing from about 2 mol % to about 25 mol % of silver iodide.

13. A silver halide color photographic material as claimed in claim 1, wherein B represents —COOM, —$COOCH_3$, —$COOC_2H_5$ or

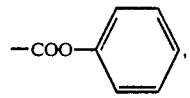

wherein M represents a hydrogen atom, an alkali metal atom, a quaternary ammonium group, or a quaternary phosphonium group.

14. A silver halide color photographic material as claimed in claim 1, wherein $Y_1$ represents

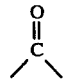

and $Z_1$ represents an atomic group necessary for forming a uracil ring.

15. A silver halide color photographic material as claimed in claim 1, wherein m is 0.

16. A silver halide color photographic material as claimed in claim 1, wherein A represents —S—$R_9(X_2$-$R_{10}\text{—}_{l1}(\text{—}B)_{l2}$.

17. A silver halide color photographic material as claimed in claim 1, wherein $R_9$, $R_{10}$ and L each represent an alkylene group which may be substituted.

18. A silver halide color photographic material as claimed in claim 1, wherein an amount of the compound represented by formula (II) to be added is from 0.1 to 50 mol % based on the total coating amount of said silver.

19. A silver halide color photographic material as claimed in claim 1, wherein an amount of the compound represented by formula (II) to be added is from 1 to 20 mol % based on the total amount of said silver.

* * * * *